US010307806B2

(12) United States Patent
Akashi et al.

(10) Patent No.: US 10,307,806 B2
(45) Date of Patent: Jun. 4, 2019

(54) ROLLING CONTROL METHOD FOR METAL STRIP, ROLLING CONTROL APPARATUS, AND MANUFACTURING METHOD FOR ROLLED METAL STRIP

(71) Applicant: NIPPON STEEL & SUMITOMO METAL CORPORATION, Tokyo (JP)

(72) Inventors: Tooru Akashi, Tokyo (JP); Shigeru Ogawa, Tokyo (JP); Kenji Yamada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/505,394

(22) PCT Filed: Aug. 11, 2015

(86) PCT No.: PCT/JP2015/072800
§ 371 (c)(1),
(2) Date: Feb. 21, 2017

(87) PCT Pub. No.: WO2016/042948
PCT Pub. Date: Mar. 24, 2016

(65) Prior Publication Data

US 2017/0259312 A1 Sep. 14, 2017

(30) Foreign Application Priority Data

Sep. 16, 2014 (JP) ..... 2014-187290

(51) Int. Cl.
*B21B 37/16* (2006.01)
*B21B 37/28* (2006.01)
*B21B 1/16* (2006.01)

(52) U.S. Cl.
CPC ..... *B21B 37/16* (2013.01); *B21B 1/16* (2013.01); *B21B 37/28* (2013.01); *B21B 2263/08* (2013.01); *B21B 2265/10* (2013.01)

(58) Field of Classification Search
None
See application file for complete search history.

(56) References Cited

U.S. PATENT DOCUMENTS

2012/0173025 A1* 7/2012 Tachibana ..... G05B 7/02 700/275

FOREIGN PATENT DOCUMENTS

EP 2 737 963 A1 6/2014
JP 7-164034 A 6/1995
(Continued)

OTHER PUBLICATIONS

International Search Report, issued in PCT/JP2015/072800, dated Nov. 17, 2015.
(Continued)

*Primary Examiner* — Pradeep C Battula
(74) *Attorney, Agent, or Firm* — Birch, Stewart, Kolasch & Birch, LLP

(57) ABSTRACT

A provisional elongation strain difference distribution $\Delta\varepsilon(x)$ of a metal strip during rolling is found under conditions in which out-of-plane deformation of the metal strip is restrained. A critical buckling strain difference distribution $\Delta\varepsilon_{cr}(x)$ is found based on the provisional elongation strain difference distribution $\Delta\varepsilon(x)$, a strip thickness and strip width of the metal strip, and tension acting on the metal strip at exit from a rolling mill. When the provisional elongation strain difference distribution $\Delta\varepsilon(x)$ exceeds the critical buckling strain difference distribution $\Delta\varepsilon_{cr}(x)$, the difference between the provisional elongation strain difference distribution $\Delta\varepsilon(x)$ and the critical buckling strain difference
(Continued)

distribution $\Delta\varepsilon_{cr}(x)$ is found, and added to the provisional elongation strain difference distribution $\Delta\varepsilon(x)$ to find a true elongation strain difference distribution $\Delta\varepsilon'(x)$. Rolling conditions are set based on the true elongation strain difference distribution $\Delta\varepsilon'(x)$, and the metal strip is rolled, thereby controlling the metal strip's profile.

11 Claims, 19 Drawing Sheets

(56) References Cited

FOREIGN PATENT DOCUMENTS

| | | | |
|---|---|---|---|
| JP | 8-1220 | A | 1/1996 |
| JP | 2005-153011 | A | 6/2005 |
| JP | 2008-112288 | A | 5/2008 |
| JP | 2012-218010 | A | 11/2012 |
| JP | 2013-3503 | A | 2/2013 |
| WO | WO 2014/054140 | A1 | 4/2014 |

OTHER PUBLICATIONS

Written Opinion of the International Searching Authority, issued in PCT/JP2015/072800, dated Nov. 17, 2015.

* cited by examiner

ROLLING CONTROL METHOD FOR METAL STRIP, ROLLING CONTROL APPARATUS, AND MANUFACTURING METHOD FOR ROLLED METAL STRIP

TECHNICAL FIELD

The present invention relates to a rolling control method for controlling the profile of a metal strip after rolling, a rolling control apparatus that performs the rolling control method, and a manufacturing method for a rolled metal strip.

BACKGROUND ART

Various methods have been proposed as technology for predicting the profile of a metal strip, such as a sheet or a plate, after rolling.

For example, Japanese Patent Application Laid-Open (JP-A) No. 2008-112288 describes technology that improves the prediction precision for an extrapolation region for which actual data does not exist, and also corrects errors in a rolling model. Specifically, a database of actual results, in which manufacturing conditions of previously manufactured products are stored associated with manufacture outcome information, is employed to compute a degree of similarity between respective samples in the database of actual results and request points (prediction target points), and to generate a prediction formula for the vicinity of the request points using weighted regression weighted by the degree of similarity. The prediction precision for the extrapolation region is improved by the prediction formula.

JP-A No. 2005-153011 describes technology that predicts the profile of a metal strip by splitting elongation strain (stress) that is distributed in a strip width direction of a metal strip during rolling into elongation strain that is geometrically transformed into a wave profile during buckling, and elongation strain still present in the metal strip after buckling.

Moreover, JP-A No. 2012-218010 describes technology that predicts the profile of a metal strip by measuring characteristic amounts of the profile of the metal strip at exit from a rolling mill, and also finding elongation strain present in the metal strip during measurement, then superimposing the elongation strain on the profile characteristic amounts, and measuring this as true profile characteristic amounts applied by the rolling mill. Note that positions in a strip passing direction of the strip and a width direction of the strip, and height direction displacement, are measured on exit from the rolling mill as geometric values. Moreover, profile, steepness, and elongation strain difference are found as the profile characteristic amounts.

SUMMARY OF INVENTION

Technical Problem

However, in the method described in JP-A No. 2008-112288, no consideration is given to non-linear phenomena such as buckling of the metal strip, and such non-linear phenomena cannot be reflected in the prediction formula. Moreover, modelling errors arise when no consideration is given to non-linear phenomena, and so the profile of the metal strip after rolling cannot be accurately predicted.

In the inventions described in JP-A Nos. 2005-153011 and 2012-218010, consideration is given to buckling of the metal strip when predicting the profile of the metal strip, thereby improving the prediction precision in comparison to cases in which buckling is not taken into consideration. However, careful investigation by the inventors has revealed that there is still room for improvement in improving the prediction precision, as explained below.

In consideration of this point, an object of the present invention is to predict the profile of a metal strip after rolling with good precision, and to give excellent control of the profile of the metal strip.

Solution to Problem

In order to achieve the above object, the inventors investigated methods for predicting the profile of a metal strip after rolling, and controlling the profile of a metal strip based on the predicted profile of the metal strip. The inventors reached the following findings.

As described in JP-A No. 2005-153011, technology is known in which rolling direction elongation strain distributed in a strip width direction of a metal strip is split into elongation strain that is geometrically transformed into a wave profile by buckling, and elongation strain still present in the metal strip after buckling. Moreover, the invention described in JP-A No. 2012-218010 expands on the invention described in JP-A No. 2005-153011, and determines a true elongation strain distribution by finding the elongation strain distribution that is not transformed into a wave profile and is still present in the metal strip after buckling, and superimposing this on the elongation strain distribution that is transformed into a wave profile of the metal strip measured on exit from the rolling mill. The profile of the metal strip is then controlled using feedback control.

The present invention expands further on the inventions described in JP-A Nos. 2005-153011 and 2012-218010. The inventors discovered that there is correlation between rolling load difference distribution and elongation strain difference distribution in the strip width direction of a metal strip that undergoes changes due to buckling. By quantitatively establishing this correlation, the inventors found that it is possible to find a true elongation strain difference distribution of the metal strip. Namely, out of the elongation strain difference distributed in the strip width direction of the metal strip, when the elongation strain difference that is transformed into a wave profile so as to cause out-of-plane deformation is transformed into a wave profile by actual buckling of the metal strip, the load distribution corresponding to the elongation strain difference is further transformed into an elongation strain difference present in the metal strip. Namely, it was found that the true elongation strain difference of the metal strip is greater than hitherto imagined. Predicting the true elongation strain difference of the metal strip in this manner enables the profile of the metal strip to be controlled with greater precision. The gist of the present invention is as follows.

A first aspect of the present invention provides a rolling control method including: finding a critical buckling strain difference distribution, which is a distribution in a strip width direction of differences in a critical strain at which a metal strip will buckle, based on a strip thickness of the metal strip, a strip width of the metal strip, tension acting on the metal strip at exit from a rolling mill, and a provisional elongation strain difference distribution which is a distribution of differences in the strip width direction of elongation strain along a rolling direction of the metal strip during rolling under specific rolling conditions, and which is found under conditions in which out-of-plane deformation of a metal strip is restrained; in cases in which the provisional elongation strain difference distribution exceeds the critical buckling strain difference distribution, finding a true elongation strain difference distribution by adding the difference between the provisional elongation strain difference distribution and the critical buckling strain difference distribution to the provisional elongation strain difference distribution; and rolling the metal strip without changing the specific rolling conditions in cases in which the provisional elongation strain difference distribution does not exceed the critical buckling strain difference distribution, and rolling the metal strip under rolling conditions set based on the true elongation strain difference distribution in cases in which the provisional elongation strain difference distribution exceeds the critical buckling strain difference distribution.

A second aspect of the present invention provides the rolling control method of the first aspect, further including finding the provisional elongation strain difference distribution.

A third aspect of the present invention provides the rolling control method of either the first aspect or the second aspect, wherein, when finding the true elongation strain difference distribution, a converted tension is found by converting a difference between the provisional elongation strain difference distribution and the critical buckling strain difference distribution into tension acting on the metal strip at exit from the rolling mill, and the true elongation strain difference distribution is found by adding an elongation strain difference distribution corresponding to the converted tension to the provisional elongation strain difference distribution.

A fourth aspect of the present invention provides the rolling control method of the third aspect, wherein, when finding the true elongation strain difference distribution, a second order differential with respect to the strip width direction of a rolling load difference distribution in the strip width direction of the metal strip corresponding to the converted tension is found as an elongation strain difference distribution corresponding to the converted tension.

A fifth aspect of the present invention provides a rolling control method including: under conditions in which out-of-plane deformation of a metal strip is restrained, finding a provisional rolling load difference distribution, which is a distribution of differences in rolling load in a strip width direction of the metal strip during rolling under specific rolling conditions, and finding a provisional elongation strain difference distribution, which is a distribution of differences in the strip width direction in elongation strain along a rolling direction of the metal strip during rolling; finding a critical buckling strain difference distribution, which is a distribution in the strip width direction of differences in a critical strain at which the metal strip will buckle, based on the provisional elongation strain difference distribution, a strip thickness of the metal strip, a strip width of the metal strip, and tension acting on the metal strip at exit from a rolling mill; in cases in which the provisional elongation strain difference distribution exceeds the critical buckling strain difference distribution, finding a critical buckling load difference distribution, which is a rolling load difference distribution corresponding to the critical buckling strain difference distribution, from a correlation between the provisional rolling load difference distribution and the provisional elongation strain difference distribution, finding a difference between the provisional rolling load difference distribution and the critical buckling load difference distribution, and finding a true elongation strain difference distribution by adding a strain difference distribution corresponding to the difference to the provisional elongation strain difference distribution under the assumption that there is no crown ratio change in the metal strip between exit from and entry to the rolling mill; and rolling the metal strip without changing the specific rolling conditions in cases in which the provisional elongation strain difference distribution does not exceed the critical buckling strain difference distribution, and rolling the metal strip under rolling conditions that are set based on the true elongation strain difference distribution in cases in which the provisional elongation strain difference distribution exceeds the critical buckling strain difference distribution.

A sixth aspect of the present invention provides a rolling control method including: under conditions in which out-of-plane deformation of a metal strip is restrained, finding a provisional rolling load difference distribution, which is a distribution of differences in rolling load in a strip width direction of the metal strip during rolling under specific rolling conditions, and finding a provisional elongation strain difference distribution, which is a distribution of differences in the strip width direction in elongation strain along a rolling direction of the metal strip during rolling; finding a critical buckling strain difference distribution, which is a distribution in the strip width direction of differences in a critical strain at which the metal strip will buckle, based on the provisional elongation strain difference distribution, a strip thickness of the metal strip, a strip width of the metal strip, and tension acting on the metal strip at exit from a rolling mill; in cases in which the provisional elongation strain difference distribution exceeds the critical buckling strain difference distribution, finding an out-of-plane deformation load difference distribution corresponding to an out-of-plane deformation strain difference distribution, which is a difference between the provisional elongation strain difference distribution and the critical buckling strain difference distribution, from a correlation between the provisional rolling load difference distribution and the provisional elongation strain difference distribution, deriving a new rolling load difference distribution by superimposing the out-of-plane deformation load difference distribution on the provisional rolling load difference distribution, finding a new elongation strain difference distribution based on the new rolling load difference distribution under the assumption that there is a change in a crown ratio of the metal strip, and further finding a new critical buckling strain difference distribution based on the new elongation strain difference distribution, the strip thickness and the strip width of the metal strip, and tension acting on the metal strip at exit from the rolling mill; finding a difference between the new elongation strain difference distribution and the new critical buckling strain difference distribution, and finding a true elongation strain difference distribution by adding this difference to the new elongation strain difference distribution; and rolling the metal strip without changing the specific rolling conditions in cases in which the provisional elongation strain difference distribution does not exceed the critical buckling strain difference distribution, and rolling the metal strip under rolling conditions that are set based on the true elongation strain difference distribution in cases in which the provisional elongation strain difference distribution exceeds the critical buckling strain difference distribution.

A seventh aspect of the present invention provides the rolling control method of the sixth aspect, wherein finding the out-of-plane deformation load difference distribution is performed plural times by taking the new elongation strain difference distribution as the provisional elongation strain difference distribution, and taking the new critical buckling strain difference distribution as the critical buckling strain difference distribution found.

An eighth aspect of the present invention provides the rolling control method of the first aspect to the seventh aspect, wherein the metal strip undergoes out-of-plane deformation at entry to the rolling mill.

A ninth aspect of the present invention provides the rolling control method of any one of the first aspect to the eighth aspect, further including: employing a profile meter installed at exit from the rolling mill to measure the profile of the metal strip after rolling; and correcting the provisional elongation strain difference distribution based on a difference between an actual elongation strain difference distribution that has been transformed into out-of-plane deformation found from a measured profile of the metal strip, and an elongation strain difference distribution predicted to be transformed into out-of-plane deformation.

A tenth aspect of the present invention provides a rolling controller including: a computation section that finds a critical buckling strain difference distribution, which is a distribution in a strip width direction of differences in a critical strain at which a metal strip will buckle, based on a strip thickness of the metal strip, a strip width of the metal strip, tension acting on the metal strip at exit from a rolling mill, and a provisional elongation strain difference distribution which is a distribution of differences in the strip width direction of elongation strain along a rolling direction of the metal strip during rolling under specific rolling conditions, and which is found under conditions in which out-of-plane deformation of a metal strip is restrained, and the computation section, in cases in which the provisional elongation strain difference distribution exceeds the critical buckling strain difference distribution, finding a true elongation strain difference distribution by adding the difference between the provisional elongation strain difference distribution and the critical buckling strain difference distribution to the provisional elongation strain difference distribution; and a control section that rolls the metal strip without changing the specific rolling conditions in cases in which the provisional elongation strain difference distribution does not exceed the critical buckling strain difference distribution, and that rolls the metal strip under rolling conditions that are set based on the true elongation strain difference distribution in cases in which the provisional elongation strain difference distribution exceeds the critical buckling strain difference distribution.

An eleventh aspect of the present invention provides a manufacturing method for a rolled metal strip, the manufacturing method including: finding a critical buckling strain difference distribution which is a distribution in a strip width direction of differences in a critical strain at which a metal strip will buckle, based on a strip thickness of the metal strip, a strip width of the metal strip, tension acting on the metal strip at exit from a rolling mill, and a provisional elongation strain difference distribution, which is a distribution of differences in the strip width direction of elongation strain along a rolling direction of the metal strip during rolling under specific rolling conditions that is found under conditions in which out-of-plane deformation of a metal strip is restrained; in cases in which the provisional elongation strain difference distribution exceeds the critical buckling strain difference distribution, finding a true elongation strain difference distribution by adding the difference between the provisional elongation strain difference distribution and the critical buckling strain difference distribution to the provisional elongation strain difference distribution; and rolling the metal strip without changing the rolling conditions in cases in which the provisional elongation strain difference distribution does not exceed the critical buckling strain difference distribution, and rolling the metal strip under rolling conditions set based on the true elongation strain difference distribution in cases in which the provisional elongation strain difference distribution exceeds the critical buckling strain difference distribution.

Advantageous Effects of Invention

According to the present invention, out of the elongation strain difference distribution in the strip width direction of the metal strip (namely, the elongation strain difference distribution of the first step), the out-of-plane deformation strain difference distribution that is transformed into a wave profile and causes out-of-plane deformation (namely, the difference between the elongation strain difference distribution of the first step and the critical buckling strain difference distribution of the second step) is added to the elongation strain difference distribution. This thereby enables precise and accurate prediction of the true elongation strain difference distribution of the metal strip. Accordingly, setting the rolling conditions based on the true elongation strain difference distribution enables excellent control of the profile of the metal strip after rolling.

DESCRIPTION OF EMBODIMENTS

Figure 1:
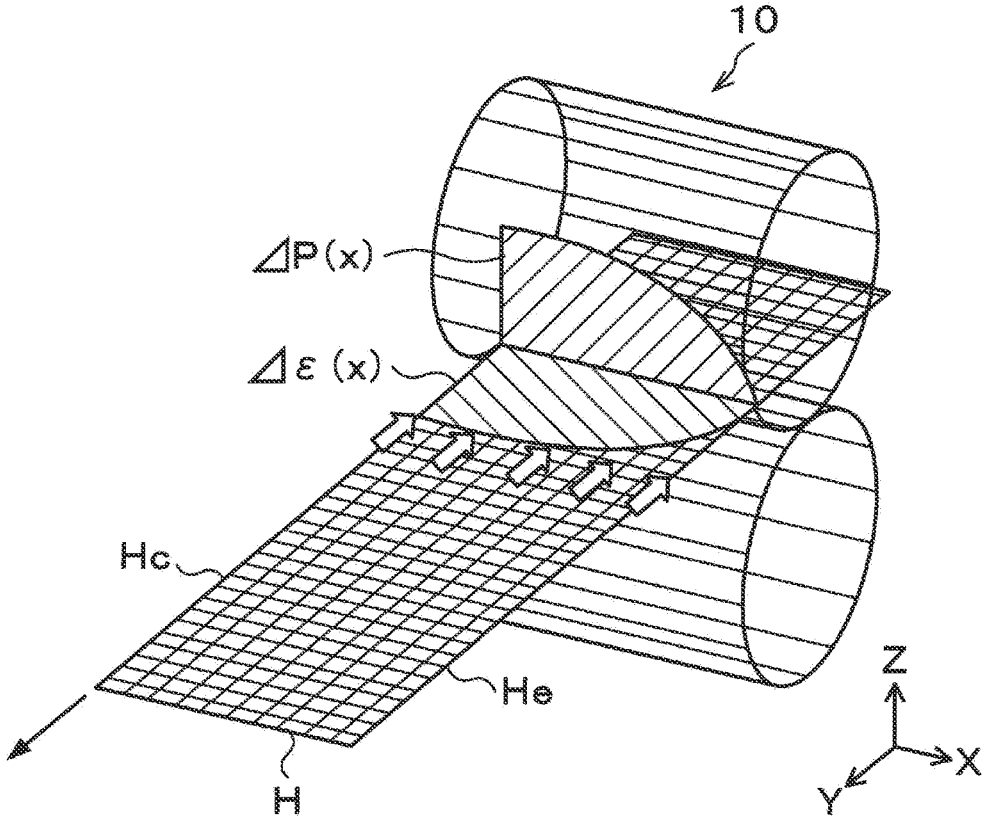
FIG. 1 is a drawing illustrating an elongation strain difference distribution $\Delta\varepsilon(x)$ and a rolling load difference distribution $\Delta P(x)$ of a steel strip in a case in which the steel strip is rolled under conditions in which out-of-plane deformation of the steel strip is restrained.

Explanation follows regarding exemplary embodiments of the present invention, with reference to the drawings. In the present specification and the drawings, configuration elements having substantially the same function as each other are allocated the same reference numerals, and duplicate explanation is omitted. Note that in the present exemplary embodiment, explanation is given regarding a case in which a steel strip is employed as a metal strip. The following explanation deals with strain and load distribution in a roll-bite of the steel strip.

Principles of Steel Strip Elongation Strain Occurrence

Figure 4:
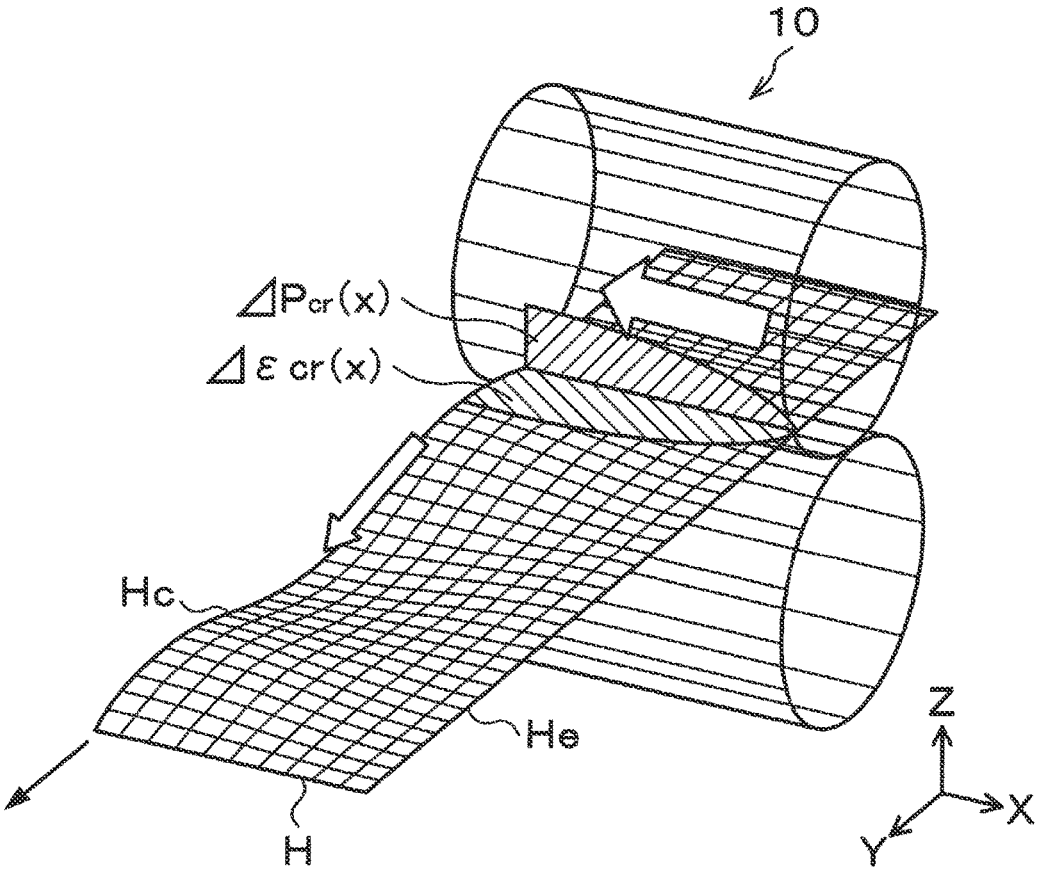
FIG. 4 is a drawing illustrating a situation in which metal flows into a reduced load region within a roll-bite and an elongation strain difference distribution in a steel strip increases.
Figure 5A:
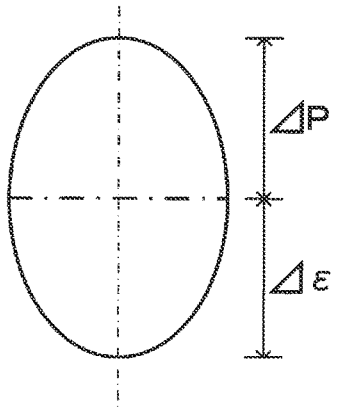
FIG. 5A is an explanatory diagram schematically illustrating a relationship between elongation strain difference and rolling load in a steel strip in plan view, and illustrates an elongation strain difference distribution $\Delta\varepsilon(x)$.
Figure 5B:
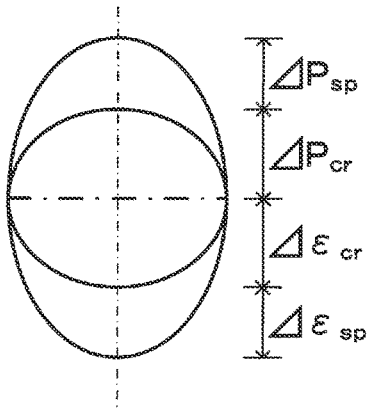
FIG. 5B is an explanatory diagram schematically illustrating a relationship between elongation strain difference and rolling load in a steel strip in plan view, and illustrates a critical buckling strain difference distribution $\Delta\varepsilon_{cr}(x)$ and an out-of-plane deformation strain difference distribution $\Delta\varepsilon_{sp}(x)$.
Figure 5C:
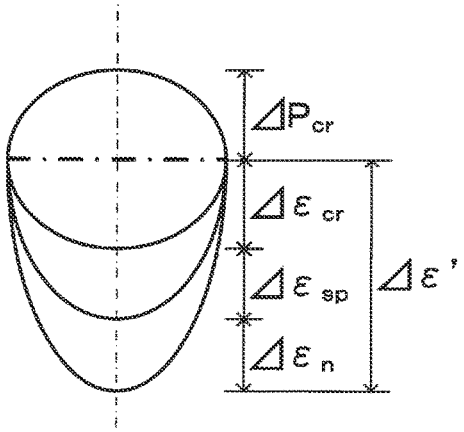
FIG. 5C is an explanatory diagram schematically illustrating a relationship between elongation strain difference and rolling load in a steel strip in plan view, and illustrates a true elongation strain difference distribution $\Delta\varepsilon'(x)$.

First, explanation follows regarding principles of the occurrence of elongation strain in a rolling direction (referred to below as "elongation strain") when a rolled steel strip buckles (when out-of-plane deformation occurs in the steel strip), with reference to FIG. 1 to FIG. 4, and FIG. 5A to FIG. 5C. FIG. 5A to FIG. 5C correspond to FIG. 1 to FIG. 4, and are explanatory diagrams schematically illustrating relationships between elongation strain difference and rolling load difference in a steel strip in plan view. Note that in the following explanation, explanation is given regarding a center wave occurring in the steel strip. The center wave refers to out-of-plane deformation in a wave profile that occurs at a strip width direction central portion of the steel strip, and is also referred to as center stretching. Here, the explanation deals with respective parameters acting on the steel strip on a conceptual level only. Details relating to methods for computing the respective parameters, for example, will follow later in an exemplary embodiment of a steel strip rolling control method.

As illustrated in FIG. 1, a steel strip H is rolled using a rolling mill 10 including a pair of rollers. The Y direction in FIG. 1 indicates the rolling direction of the steel strip H, and the steel strip H is conveyed and rolled in the Y direction from a negative direction side toward a positive direction side. The X direction in FIG. 1 indicates the strip width direction of the steel strip H. FIG. 1 illustrates half of the steel strip H in the strip width direction, namely from a center $H_c$ to an edge $H_e$ in the strip width direction of the steel strip H.

FIG. 1 illustrates an elongation strain difference distribution $\Delta\varepsilon(x)$ in the strip width direction of the steel strip H in a roll-bite, and a rolling load difference distribution $\Delta P(x)$ acting in a vertical direction of the steel strip H (Z direction) across the strip width direction, in a case in which the steel strip H is rolled under a condition in which out-of-plane deformation of the steel strip H is restrained (namely, a condition in which out-of-plane deformation of the steel strip H is not permitted). The elongation strain difference distribution $\Delta\varepsilon(x)$ is a distribution of the elongation strain difference at a strip width direction position x relative to elongation strain at the strip width direction center $H_c$ of the steel strip H. Similarly, the rolling load difference distribution $\Delta P(x)$ is a distribution of the rolling load difference at a strip width direction position x relative to rolling load at the strip width direction center $H_c$ of the steel strip H. Moreover, the elongation strain difference distribution $\Delta\varepsilon(x)$ and the rolling load difference distribution $\Delta P(x)$ have a 1:1 correspondence in the strip width direction. In FIG. 1, since out-of-plane deformation of the steel strip H is restrained, compressive stress is generated in the rolling direction immediately after the roll-bite on exit (see the large arrows in FIG. 1). A relationship between the elongation strain difference distribution $\Delta\varepsilon(x)$ and the rolling load difference distribution $\Delta P(x)$ illustrated in FIG. 1 is schematically illustrated in FIG. 5A.

Figure 2:
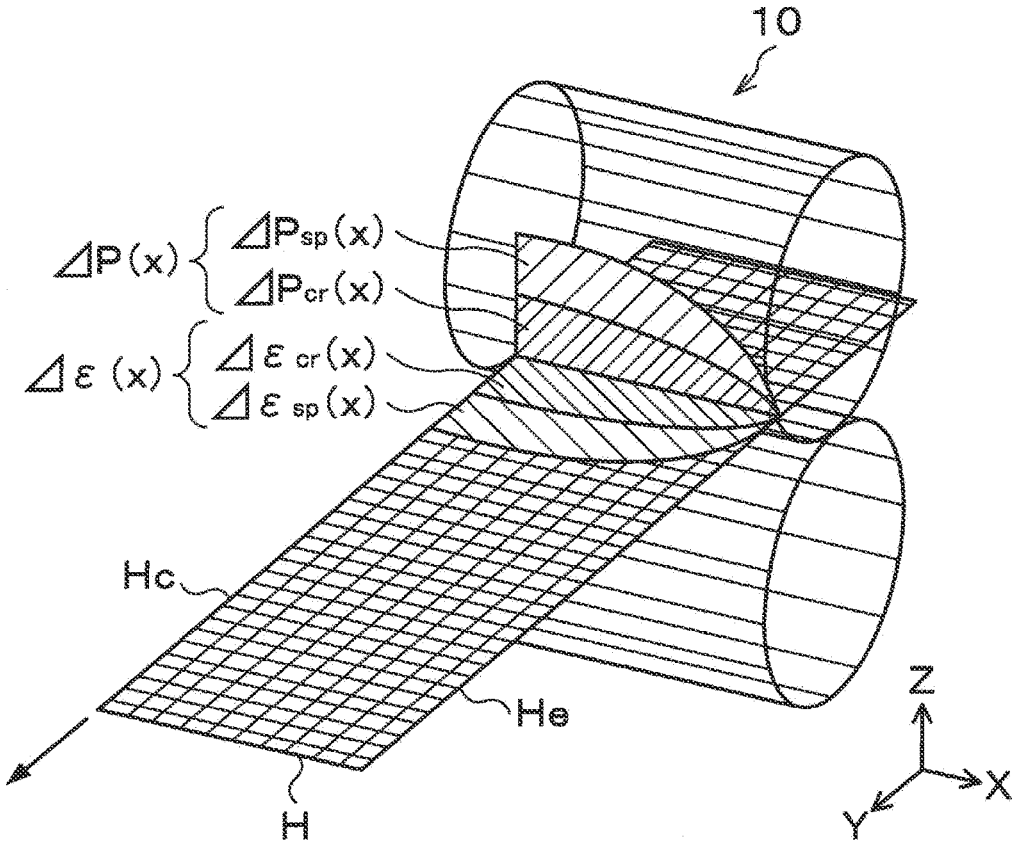
FIG. 2 is a drawing illustrating a critical buckling strain difference distribution $\Delta\varepsilon_{cr}(x)$ and an out-of-plane deformation strain difference distribution $\Delta\varepsilon_{sp}(x)$ configuring an elongation strain difference distribution $\Delta\varepsilon(x)$, and a critical buckling load difference distribution $\Delta P_{cr}(x)$ and an out-of-plane deformation load difference distribution $\Delta P_{sp}(x)$ configuring a rolling load difference distribution $\Delta P(x)$, in a case in which a steel strip is rolled under conditions in which out-of-plane deformation of the steel strip is restrained.

As illustrated in FIG. 2, the elongation strain difference distribution $\Delta\varepsilon(x)$ is split into an elongation strain difference distribution $\Delta\varepsilon_{cr}(x)$ that is still present in the steel strip H after buckling (referred to below as the critical buckling strain difference distribution $\Delta\varepsilon_{cr}(x)$), and an elongation strain difference distribution $\Delta\varepsilon_{sp}(x)$ that is transformed into wave shaped out-of-plane deformation after buckling (referred to below as the out-of-plane deformation strain difference distribution $\Delta\varepsilon_{sp}(x)$). Of these, the critical buckling strain difference distribution $\Delta\varepsilon_{cr}(x)$ is a strain difference distribution of the limit at which the steel strip H would buckle were the strain difference to increase any further. In other words, the critical buckling strain difference distribution $\Delta\varepsilon_{cr}(x)$ is a distribution in the strip width direction of differences in the critical strain at which the steel strip H will buckle. Similarly, the rolling load difference distribution $\Delta P(x)$ is split into a rolling load difference distribution $\Delta P_{cr}(x)$ (referred to below as the critical buckling load difference distribution $\Delta P_{cr}(x)$) that has a 1:1 correspondence in the strip width direction with the critical buckling strain difference distribution $\Delta\varepsilon_{cr}(x)$, and a rolling load difference distribution $\Delta P_{sp}(x)$ (referred to below as the out-of-plane deformation load difference distribution $\Delta P_{sp}(x)$) that has a 1:1 correspondence in the strip width direction with the out-of-plane deformation strain difference distribution $\Delta\varepsilon_{sp}(x)$. Note that the critical buckling strain difference distribution $\Delta\varepsilon_{cr}(x)$, the out-of-plane deformation strain difference distribution $\Delta\varepsilon_{sp}(x)$, the critical buckling load difference distribution $\Delta P_{cr}(x)$, and the out-of-plane deformation load difference distribution $\Delta P_{sp}(x)$ illustrated in FIG. 2 are schematically illustrated in FIG. 5B.

Figure 3:
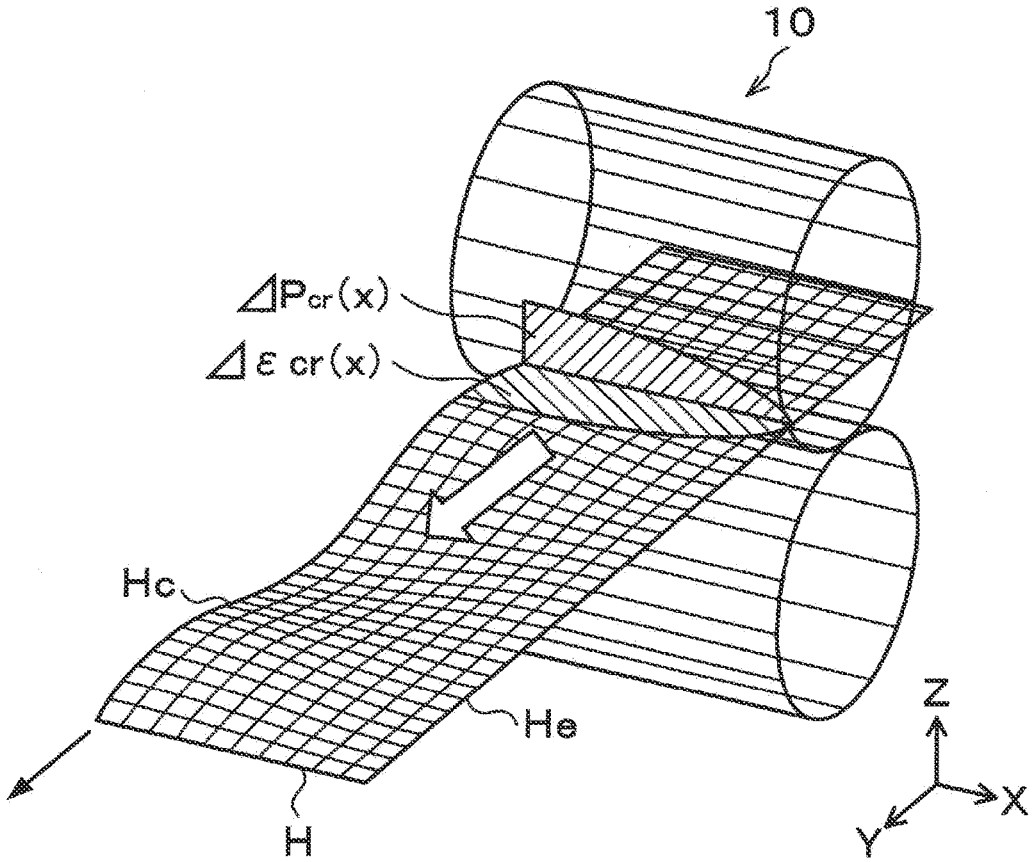
FIG. 3 is a drawing illustrating a state after an out-of-plane deformation strain difference distribution $\Delta\varepsilon_{sp}(x)$ and an out-of-plane deformation load difference distribution $\Delta P_{sp}(x)$ have disappeared in a case in which out-of-plane deformation of a steel strip is permitted.

Then, when out-of-plane deformation of the steel strip H is permitted, as illustrated in FIG. 3, the out-of-plane deformation strain difference distribution $\Delta\varepsilon_{sp}(x)$ is transformed into out-of-plane deformation and disappears. Moreover, the compressive stress illustrated by the large arrows in FIG. 1 decreases, and apparent tension acting in the rolling direction of the steel strip H increases (see the large arrow in FIG. 3). When this occurs, rolling load matching this tension, namely the out-of-plane deformation load difference distribution $\Delta P_{sp}(x)$ corresponding to the out-of-plane deformation strain difference distribution $\Delta\varepsilon_{sp}(x)$, disappears. When the out-of-plane deformation load difference distribution $\Delta P_{sp}(x)$ disappears, as illustrated in FIG. 4, metal flows in the strip width direction toward a reduced load region, namely from the edge $H_e$ toward the center $H_c$ of the steel strip H (see the large arrow in FIG. 4). As a result, due to the principle of constant volume, the elongation strain at the center $H_c$ of the steel strip H increases according to the amount of metal that flows in along the strip width direction. Namely, an increase in elongation strain difference occurs corresponding to the disappearance of the out-of-plane deformation load difference distribution $\Delta P_{sp}(x)$ (see the thinner arrow in FIG. 4). Accordingly, as illustrated in FIG. 5C, a true elongation strain difference distribution $\Delta\varepsilon'(x)$ of the steel strip H can be obtained by adding an elongation strain difference distribution $\Delta\varepsilon_n(x)$ that has increased corresponding to the disappearance of the out-of-plane deformation load difference distribution $\Delta P_{sp}(x)$ (this is referred to below as the buckling exacerbation strain difference distribution $\Delta\varepsilon_n(x)$) to the elongation strain difference distribution $\Delta\varepsilon(x)$ when out-of-plane deformation of the steel strip H is restrained, illustrated in FIG. 1. The buckling exacerbation strain difference distribution $\Delta\varepsilon_n(x)$ is an elongation strain difference distribution arising as a result of buckling of the steel strip H, and is an unobserved strain difference distribution in cases in which out-of-plane deformation of the steel strip H is restrained since buckling does not occur. Note that the out-of-plane deformation strain difference distribution $\Delta\varepsilon_{sp}(x)$ and the buckling exacerbation strain difference distribution $\Delta\varepsilon_n(x)$ are both elongation strain difference distributions corresponding to the out-of-plane deformation load difference distribution $\Delta P_{sp}(x)$, and are equivalent distributions to each other. However, they are referred to by different terms for the sake of convenience.

As described above, as a result of careful investigation by the inventor into rolling load difference distribution and elongation strain difference distribution in the strip width direction of the steel strip H that undergoes changes as a result of buckling, it has been found that when out-of-plane deformation of the steel strip H is restrained, there is correlation between the rolling load difference distribution $\Delta P(x)$ and the elongation strain difference distribution $\Delta\varepsilon(x)$ illustrated in FIG. 5A, and there is also correlation between the rolling load difference distributions $\Delta P_{cr}(x)$, $\Delta P_{sp}(x)$ and the elongation strain difference distribution $\Delta\varepsilon_{cr}(x)$, $\Delta\varepsilon_{sp}(x)$ illustrated in FIG. 5B. Based on this, it has been found that when out-of-plane deformation of the steel strip H is permitted, there are correlations between the rolling load difference distribution $\Delta P_{cr}(x)$ and the elongation strain difference distributions $\Delta\varepsilon_{cr}(x)$, $\Delta\varepsilon_{sp}(x)$, $\Delta\varepsilon_n(x)$ illustrated in FIG. 5C, and these correlations have been quantitatively established. Moreover, it has also been found that the true elongation strain difference distribution $\Delta\varepsilon'(x)$ illustrated in FIG. 5C increases more than the elongation strain difference distribution $\Delta\varepsilon(x)$ obtained under conditions in which out-of-plane deformation is restrained, as illustrated in FIG. 5A and FIG. 5B, by an amount corresponding to the buckling exacerbation strain difference distribution $\Delta\varepsilon_n(x)$, leading to the derivation of Equation 1 below. Note that the elongation strain difference distributions described in JP-A Nos. 2005-153011 and 2012-218010 are the same as the elongation strain difference distribution $\Delta\varepsilon(x)$ illustrated in FIG. 5B. The true elongation strain difference distribution $\Delta\varepsilon'(x)$ derived using the method represented by Equation (1) in the present invention is closer to the actual elongation strain difference distribution than the elongation strain difference distributions derived using the known methods.

$$\Delta\varepsilon'(x)=\Delta\varepsilon(x)+\Delta\varepsilon_n(x) \tag{1}$$

First Exemplary Embodiment

Figure 6:
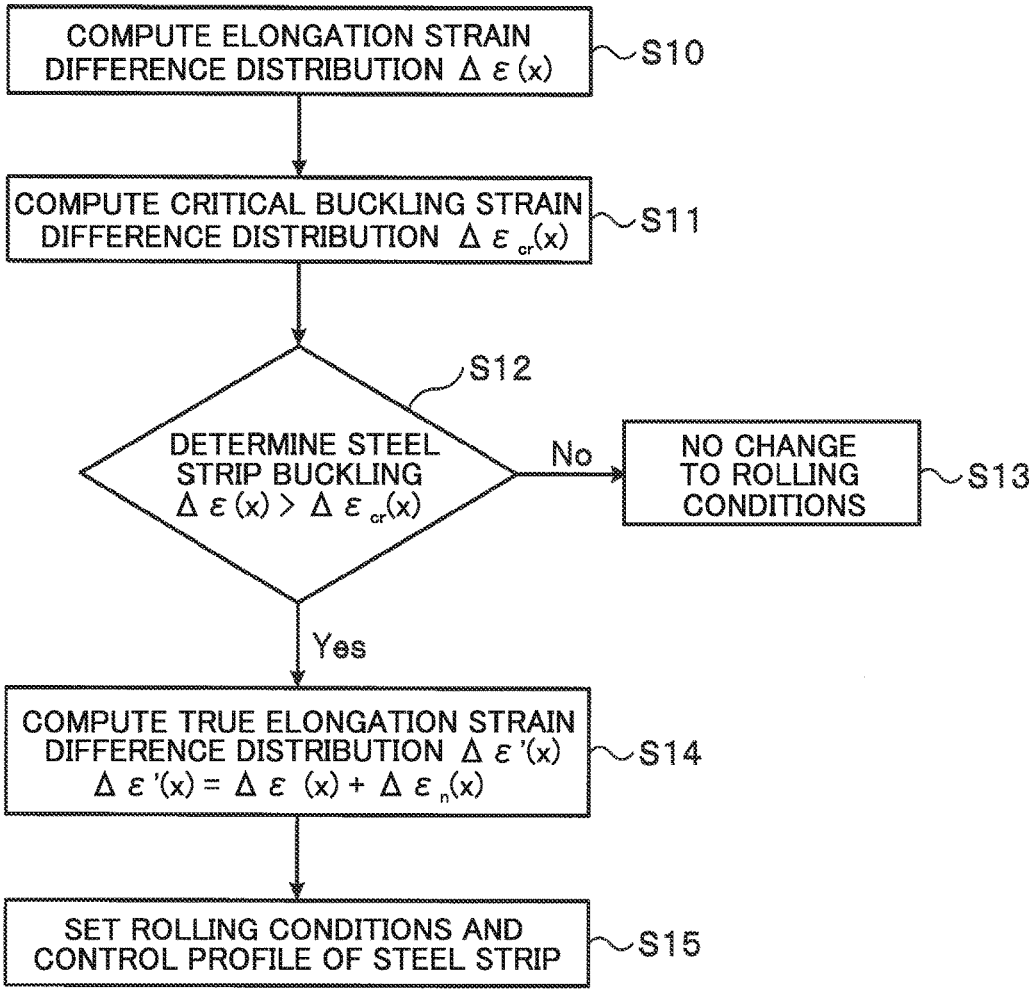
FIG. 6 is a flowchart illustrating a steel strip rolling control method of a first exemplary embodiment.

Next, explanation follows regarding a first exemplary embodiment of a method for controlling the profile of the steel strip H after rolling, based on the findings described above. FIG. 6 is a flowchart illustrating a rolling control method for the steel strip H in the first exemplary embodiment.

First, under conditions in which out-of-plane deformation of the steel strip H is restrained, a provisional elongation strain difference distribution $\Delta\varepsilon(x)$ in the strip width direction of the steel strip H during rolling under specific rolling conditions is found (step S10 in FIG. 6). The provisional elongation strain difference distribution $\Delta\varepsilon(x)$ may be computed using a known method, such as a Finite Element Method (FEM), a slab method, physical modeling, or a regression formula from experimentation or computation. Step S10 is known technology.

The modeling used to predict the rolled profile at step S10 is already in use. Strip crown prediction formulas that are necessary during real operations are respectively found for individual rolling mills using statistical methods, based on computed results using numerical analysis methods. For example, as described in Document 1 below, a method exists that employs a strip crown prediction formula for exit from a general rolling mill to derive a strip crown by separating factors dependent on only elastic deformation conditions of the rolling mill from factors dependent on plastic deformation conditions of the rolled material.

Document 1: Shigeru Ogawa, Hiromi Matsumoto, Shuichi Hamauzu, Toshio Kikuma: Plasticity and Technology (Journal of the Japan Society for Technology of Plasticity), Vol. 25, No. 286 (November 1984), 1034-1041.

Employing this method enables the strip crown at entry to and the strip crown at exit from the rolling mill to be found. Moreover, it is possible to find an elongation strain difference $\Delta\varepsilon$ by multiplying a shape change coefficient $\xi$ found through separate experimentation by a crown ratio change (Ch/h−CH/H). Namely, the elongation strain difference $\Delta\varepsilon$ can be expressed using Equation (2) below.

$$\Delta\varepsilon=\xi\cdot(Ch/h-CH/H) \tag{2}$$

wherein CH is the crown on entry to the rolling mill, H is the strip thickness at entry to the rolling mill, Ch is the crown at exit from the rolling mill, and h is the strip thickness at exit from the rolling mill. At step S10, the provisional elongation strain difference distribution $\Delta\varepsilon(x)$ can be found based on Equation (2).

Next, the critical buckling strain difference distribution $\Delta\varepsilon_{cr}(x)$ in the strip width direction of the steel strip H is found based on the provisional elongation strain difference distribution $\Delta\varepsilon(x)$ found at step S10, the strip thickness and strip width of the steel strip H, and the tension acting on the steel strip H at exit from the rolling mill (step S11 in FIG. 6). Specifically, the critical buckling strain difference distribution $\Delta\varepsilon_{cr}(x)$, which is the strip width direction critical elongation strain difference distribution at which the steel strip H will buckle, is computed by FEM or flat strip buckling analysis employing the provisional elongation strain difference distribution $\Delta\varepsilon(x)$, the strip thickness and strip width of the steel strip H, and the tension acting on the steel strip H.

Note that flat strip buckling analysis is, for example, performed employing buckling modeling formulated using a known triangular residual stress distribution (critical buckling strain difference distribution) described in the Journal of the Japan Society for Technology of Plasticity: Plasticity and Technology, Vol. 28, No. 312 (January 1987), pp 58 -66 (referred to below as Document 2) or alternatively, by following the method described in JP-A No. 2005-153011 using a distribution arrived at by discretization in a chosen manner. In particular, the method described in JP-A No. 2005-153011 is formulated so as to enable analysis even using a stress distribution resulting from residual stress distributed in a chosen manner in the width direction, and so as to enable buckling analysis even for residual stress discretized at each position in the strip width direction.

Moreover, buckling modeling employing, for example, the method described in the collected papers from the 63rd Japanese Joint Conference for the Technology of Plasticity (November 2012: Akaishi, Yasuzawa, and Ogawa) (referred to below as Document 3) enables critical buckling strain (stress) to be computed by inputting strip thickness, strip width, and tension, and a residual strain (or residual stress) having a distribution in the strip width direction and being uniform in the rolling direction.

JP-A No. 2005-153011 and Document 3 discuss methods for finding buckling strain and buckling modes using buckling analysis, and using the results of thereof to make flatness predictions for out-of-plane deformation after buckling, and to estimate residual strain after out-of-plane deformation. Explanation follows regarding the methods described in JP-A No. 2005-153011 and Document 3.

The methods make the following assumptions.

(a) That a metal strip is a thin flat strip and that residual plastic strain in the strip width direction is uniformly distributed in the rolling direction and in the thickness direction.

(b) When considering unit tension, even if residual stress generated as a result of plastic strain is distributed, integrating in the strip width direction matches a unit tension.

(c) That plastic strain should consider rolling direction strain, and other components may be ignored.

These methods employ an energy method in order to solve a buckling problem for a flat strip with plastic strain in line with the above assumptions. The energy method employed in buckling analysis is determined by a Trefftz determination standard. Moreover, the contents of Document 2 are utilized for the necessary relationships and basic logic regarding stress, strain, displacement, strain energy, potential energy, and the like. Additional considerations in order to predict the buckled shape using these methods in cases in which non-uniform plastic strain is generated in the strip width direction are given below. Note that in the coordinate system employed, the x axis is the rolling direction, the y axis is the strip width direction, and the z axis is the strip thickness direction.

(A) The strip width direction y axis is divided into elements, and residual strain for evaluating the buckled shape is allocated in a chosen manner to each element i as plastic strain $\varepsilon_x^*(i)$.

Figure 19A:
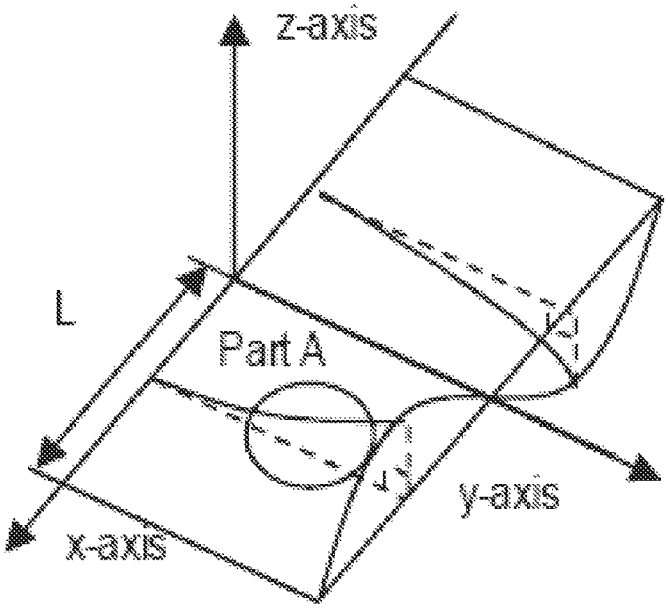
FIG. 19A is a model diagram for a deflection function.
Figure 19B:
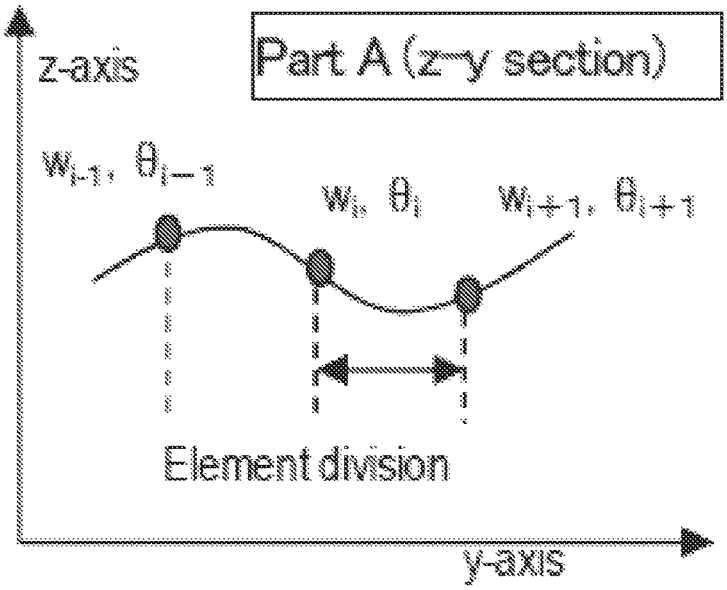
FIG. 19B is a model diagram for a deflection function.

(B) In order to consider non-uniformity in the plastic strain in the strip width direction, a deflection function employs a beam element having two nodal points such as part A in FIG. 19A and FIG. 19B, and a deflection amount in the strip width direction is expressed by the three-dimensional function of Equation (3).

$$w(y)=a_1+a_2y+a_3y^2+a_4y^3 \tag{3}$$

Moreover, since displacement in the rolling direction generally has a periodic sine waveform, a sine wave function is used as a multiplier to give Equation (4).

$$w(x,y)=w(y)\cdot\sin(\pi x/L) \tag{4}$$

wherein L is a half-cycle pitch (half the wavelength) of the sine wave.

The analysis using these methods includes discretizing the plastic strain and displacement functions into respective elements as described above, performing a variant operation of $\delta(\delta^2\pi)$ on the second variant $\delta^2\pi$ of the total potential energy based on the governing equation in Document 2, and finding an answer that satisfies F=0 for the following Equation (5), namely finding buckling stress and a buckling mode as an answer for a particular problem.

$$\begin{aligned} F &= \delta(\delta^2\pi) \\ &= 2\int\int_R [\delta w_{1,x}\{H\sigma_f + EH(\varepsilon_m^* - \varepsilon_x^*)\}]w_{1,x}]dxdy + \\ &\quad 2D\int\int_R [\delta w_{1,xx}w_{1,xx} + \delta w_{1,yy}w_{1,yy} + \\ &\quad \nu(\delta w_{1,xx}w_{1,yy} + \delta w_{1,yy}W_{1,xx}) + 2(1-\nu)\delta w_{1,xy}w_{1,xy}]dxdy \end{aligned} \tag{5}$$

wherein the suffix 1 is a small increment in displacement after buckling, $\varepsilon_x^*$ is plastic strain, $\varepsilon_m^*$ is an average value of $\varepsilon_x^*$ in the strip width direction, H is the strip thickness, $\sigma_f$ is the unit tension stress, E is the Young's modulus, $\nu$ is the Poisson's ratio, and $D=EH^3/12\ (1-\nu^2)$. As a result, this enables the critical buckling strain difference distribution $\Delta\varepsilon_{cr}(x)$ to be found.

Next, determination is made as to whether or not the steel strip H will buckle (step S12 in FIG. 6). Specifically, determination is made as to whether or not the provisional elongation strain difference distribution $\Delta\varepsilon(x)$ found at step S10 and the critical buckling strain difference distribution $\Delta\varepsilon_{cr}(x)$ found at step S11 satisfy the following Equation (6).

$$\Delta\varepsilon(x)>\Delta\varepsilon_{cr}(x) \tag{6}$$

Figure 7:
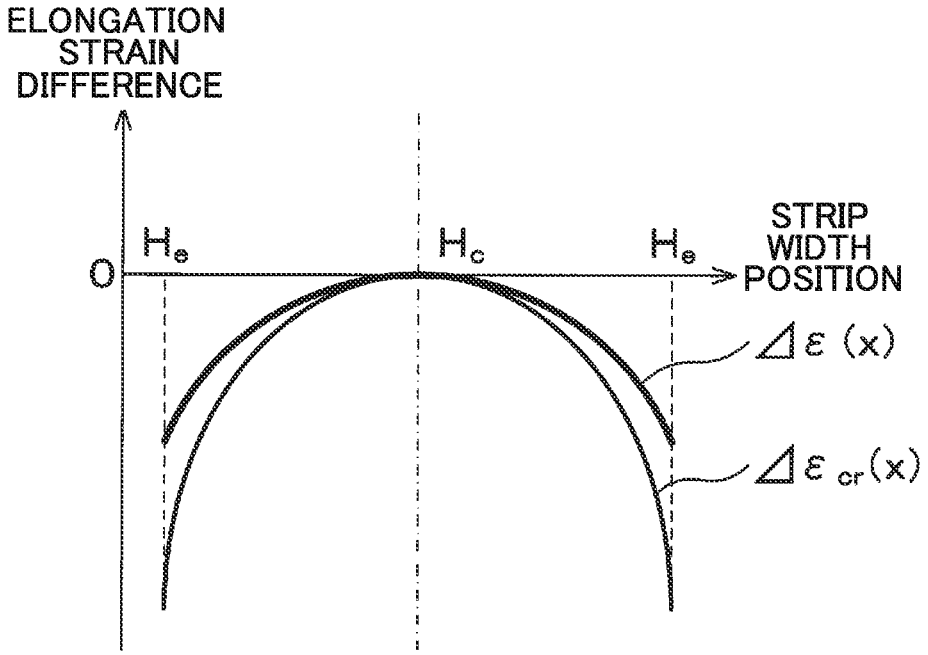
FIG. 7 is a diagram illustrating a situation in which an elongation strain difference distribution $\Delta\varepsilon(x)$ does not exceed a critical buckling strain difference distribution $\Delta\varepsilon_{cr}(x)$.

As illustrated in FIG. 7, if Equation (6) is not satisfied at step S12, and determination is made that the provisional elongation strain difference distribution $\Delta\varepsilon(x)$ found at step S10 does not exceed the critical buckling strain difference distribution $\Delta\varepsilon_{cr}(x)$ found at step S11, then it is presumed that the steel strip H will not buckle and will be flat. In such cases, the profile of the steel strip H is controlled by rolling the steel strip H with the rolling conditions left as they are, unchanged (step S13 in FIG. 6). Note that FIG. 7 is a diagram illustrating an elongation strain difference distribution in the strip width direction, similarly to FIG. 1 to FIG. 4, and FIG. 5A to FIG. 5C, taking the elongation strain at the strip width direction center $H_c$ of the steel strip H as 0. Accordingly, when illustrated as in FIG. 7, the elongation strain at the edges $H_e$ of the steel strip are negative values. Similar also applies in FIG. 8.

Figure 8:
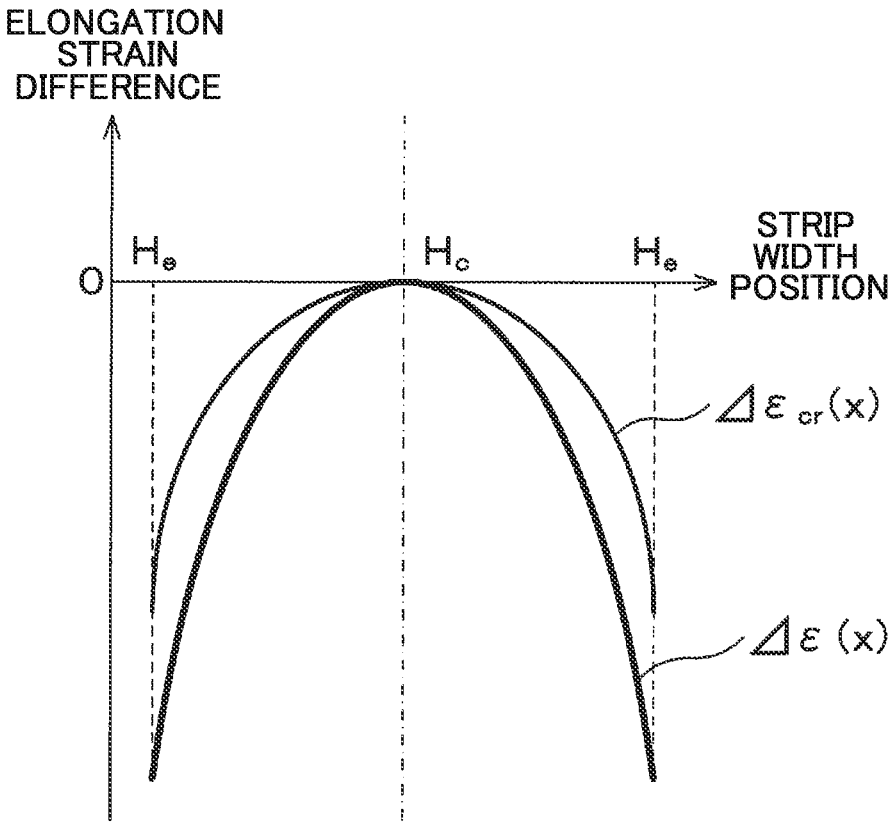
FIG. 8 is a diagram illustrating a situation in which an elongation strain difference distribution $\Delta\varepsilon(x)$ exceeds a critical buckling strain difference distribution $\Delta\varepsilon_{cr}(x)$.
Figure 9:
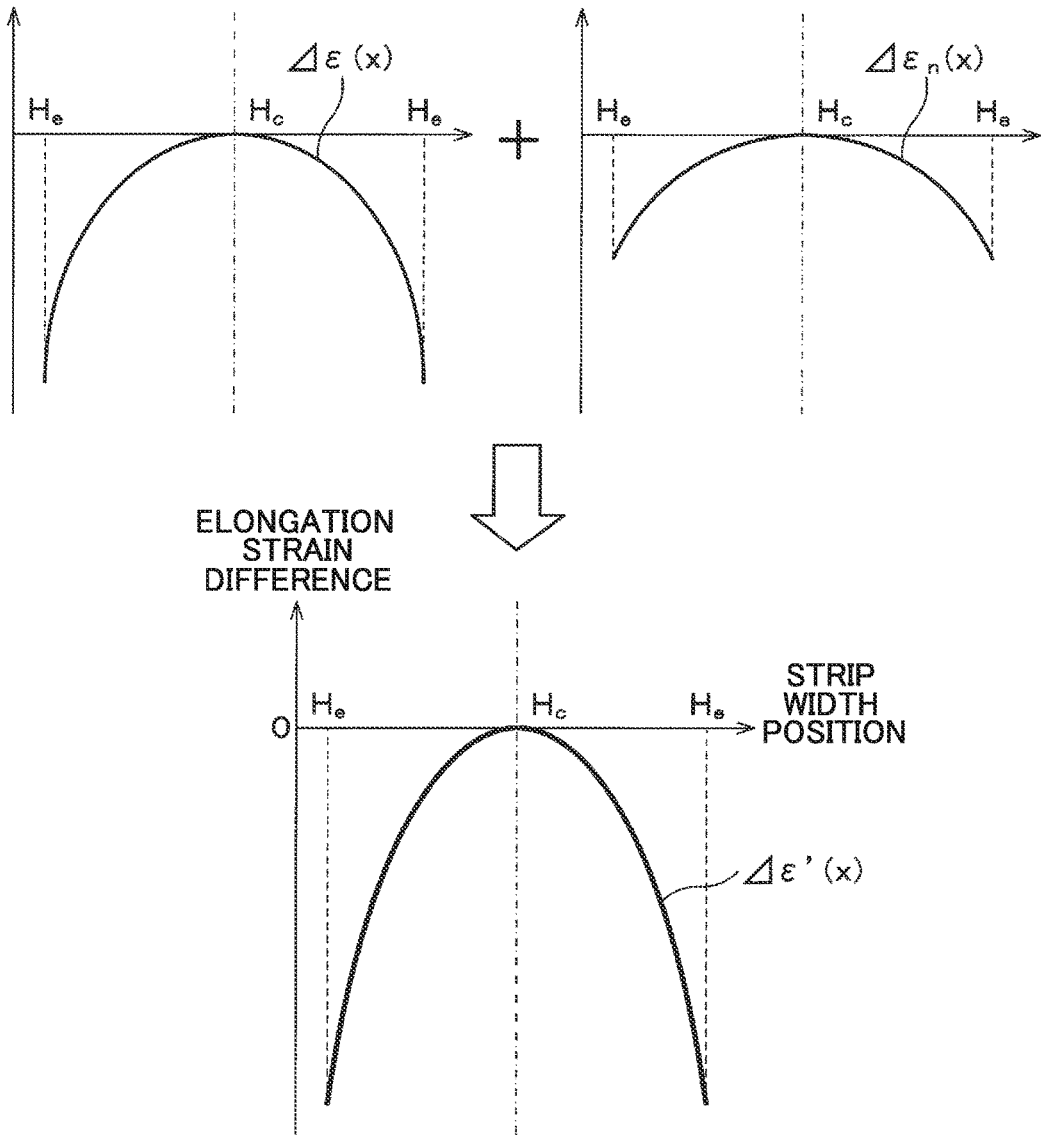
FIG. 9 is a diagram illustrating the concept of a true elongation strain difference distribution $\Delta\varepsilon'(x)$.

However, as illustrated in FIG. 8, if Equation (6) is satisfied at step S12, and determination is made that the provisional elongation strain difference distribution $\Delta\varepsilon(x)$ found at step S10 exceeds the critical buckling strain difference distribution $\Delta\varepsilon_{cr}(x)$ found at step S11, it is presumed that the steel strip H will buckle. In such cases, the difference between the provisional elongation strain difference distribution $\Delta\varepsilon(x)$ found at step S10 and the critical buckling strain difference distribution $\Delta\varepsilon_{cr}(x)$ found at step S11 is found. This difference is the buckling exacerbation strain difference distribution $\Delta\varepsilon_n(x)$ illustrated in FIG. 5C ($\Delta\varepsilon_n(x)=\Delta\varepsilon(x)-\Delta\varepsilon_{cr}(x)$). Then, as illustrated in FIG. 9, Equation (1) is used to find the true elongation strain difference distribution $\Delta\varepsilon'(x)$ by adding the buckling exacerbation strain difference distribution $\Delta\varepsilon_n(x)$ to the provisional elongation strain difference distribution $\Delta\varepsilon(x)$ found at step S10 (step S14 in FIG. 6).

Next, the profile of the steel strip H is controlled by setting rolling conditions based on the true elongation strain difference distribution $\Delta\varepsilon'(x)$ found at step S14, and rolling the steel strip H (step S15 in FIG. 6). Specifically, the rolling conditions are set such that, for example, the true elongation strain difference distribution $\Delta\varepsilon'(x)$ becomes equal to or lower than the critical buckling strain difference distribution $\Delta\varepsilon_{cr}(x)$. Accordingly, the steel strip H does not buckle, and is flat after rolling. The rolling conditions include, for example, rolling load, and roller bend moment that controls deflection of the rollers. Note that the rolling conditions can be set in a chosen manner, and the true elongation strain difference distribution $\Delta\varepsilon'(x)$ may be determined using the present algorithm to control the profile of the steel strip H after rolling as necessary.

According to the first exemplary embodiment, the true elongation strain difference distribution $\Delta\varepsilon'(x)$ of the steel strip H is found by adding the buckling exacerbation strain difference distribution $\Delta\varepsilon_n(x)$ found at step S14 to the provisional elongation strain difference distribution $\Delta\varepsilon(x)$ found at step S10. By finding the elongation strain difference distribution in this manner, the prediction precision of the elongation strain difference distribution can be increased in comparison to hitherto. Accordingly, setting the rolling conditions based on the true elongation strain difference distribution $\Delta\varepsilon'(x)$ enables excellent control of the profile of the steel strip H after rolling.

Figure 10:
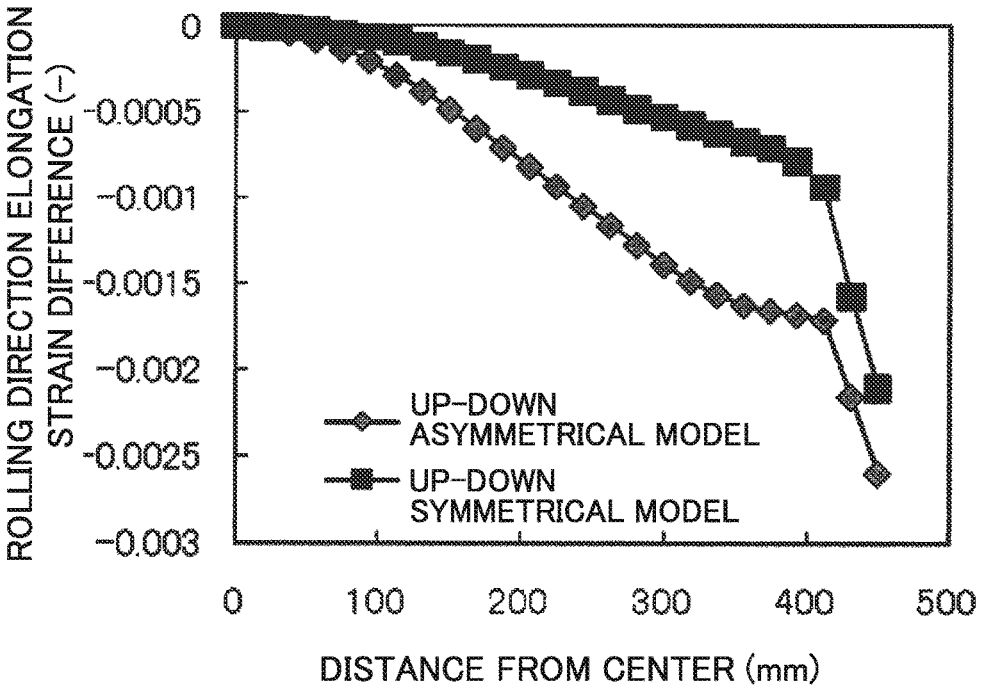
FIG. 10 is a graph to explain advantageous effects of the first exemplary embodiment.
Figure 11:
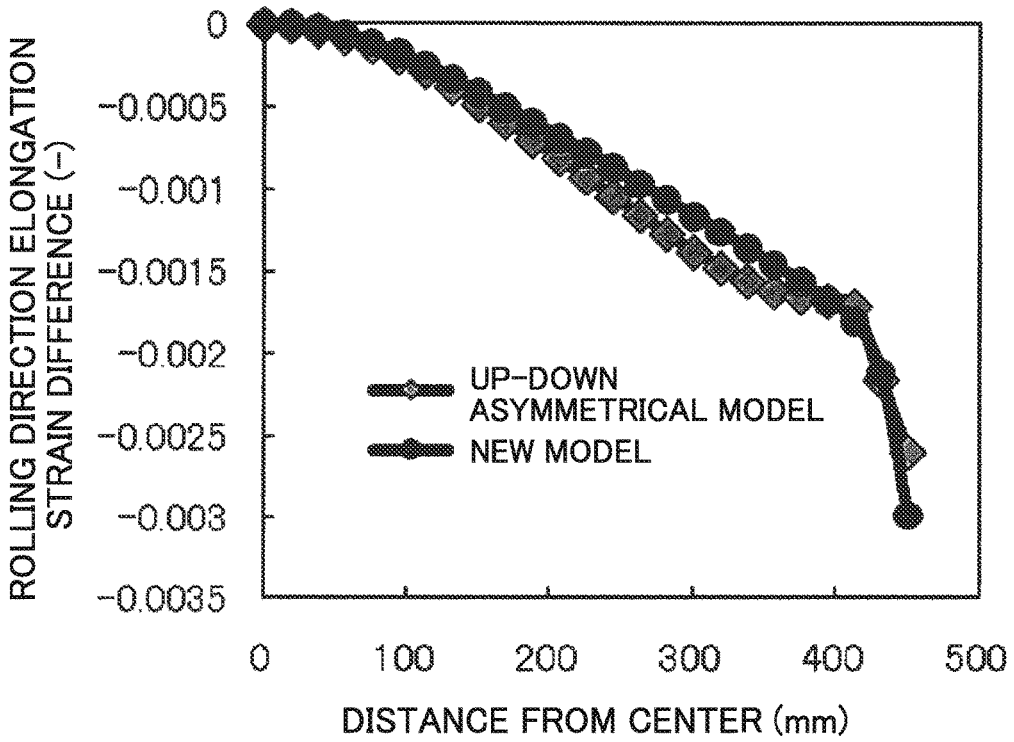
FIG. 11 is a graph to explain advantageous effects of the first exemplary embodiment.

FIG. 10 and FIG. 11 are graphs explaining advantageous effects of the first exemplary embodiment. The horizontal axes in FIG. 10 and FIG. 11 indicate the distance from the center of the steel strip, and the vertical axes indicate elongation strain difference in the rolling direction of the steel strip. Note that the elongation strain differences in FIG. 10 and FIG. 11 are values relative to the center of the steel strip (taking this as zero). The up-down asymmetrical model in FIG. 10 and FIG. 11 is an FEM model for rolling under conditions in which out-of-plane deformation of the steel strip H is permitted, and elongation strain differences found using this rolling model are actual elongation strain differences. By contrast, the up-down symmetrical model in FIG. 10 is an FEM model for rolling under conditions in which out-of-plane deformation of the steel strip H is restrained. The new model in FIG. 11 is a rolling model of the first exemplary embodiment, and is a model reflecting the true elongation strain difference distribution $\Delta\varepsilon'(x)$ described above. Simulations of rolling steel strip were performed using each model.

As illustrated in FIG. 10, the elongation strain difference distribution found using a known up-down symmetrical model differs from the elongation strain difference distribution found using the up-down asymmetrical model. By contrast, as illustrated in FIG. 11, the elongation strain difference distribution found using the new model of the first exemplary embodiment is almost the same as the elongation strain difference distribution found using the up-down asymmetrical model. It can therefore be seen that the first exemplary embodiment enables the elongation strain difference distribution of the steel strip to be predicted more precisely and accurately than hitherto.

Further investigations by the inventors revealed that when the profile of the steel strip was controlled using the method described in the first exemplary embodiment, yield due to profile was improved by 1% in comparison to hitherto.

Note that in the first exemplary embodiment, the true elongation strain difference distribution $\Delta\varepsilon'(x)$ may be found based on tension fluctuations caused by buckling at exit from the rolling mill. Specifically, at step S14 the found buckling exacerbation strain difference distribution $\Delta\varepsilon_n(x)$ is converted into tension acting on the steel strip H. A change $\Delta P_n(x)$ in the rolling load difference distribution in the strip width direction arising due to tension fluctuations at exit from the rolling mill is found, and then, as in Equation (7) below, a second order differential is taken of $\Delta P_n'(x)$ with respect to the strip width direction x to find the elongation strain difference distribution $\Delta\varepsilon_n'(x)$. Then, as in Equation (8) below, the elongation strain difference distribution $\Delta\varepsilon_n'(x)$ found with Equation (7) is added to the provisional elongation strain difference distribution $\Delta\varepsilon(x)$ found at step S10 to find the true elongation strain difference distribution $\Delta\varepsilon'(x)$.

$$\Delta\varepsilon_n'(x)=d^2\Delta P_n(x)/dx^2 \tag{7}$$

$$\Delta\varepsilon'(x)=\Delta\varepsilon(x)+\Delta\varepsilon_n'(x) \tag{8}$$

In this manner, converted tensions from converting the buckling exacerbation strain difference distribution $\Delta\varepsilon_n(x)$ into tension are initially found, and then the elongation strain difference distribution $\Delta\varepsilon_n'(x)$ corresponding to the converted tensions is found, such that the found elongation strain difference distribution $\Delta\varepsilon_n'(x)$ closer approximates to reality. Moreover, when finding the elongation strain difference distribution $\Delta\varepsilon_n'(x)$, a second order differential is taken of the change $\Delta Pn(x)$ in the rolling load difference distribution, thereby getting even closer to reality. This thereby enables the true elongation strain difference distribution $\Delta\varepsilon'(x)$ of the steel strip H to be predicted even more precisely.

Note that in the present exemplary embodiment, the provisional elongation strain difference distribution $\Delta\varepsilon(x)$ is found at step S10. However, step S10 may be omitted in cases in which the provisional elongation strain difference distribution $\Delta\varepsilon(x)$ is already known, or in cases in which a previously found value may be employed. In such cases, the known provisional elongation strain difference distribution $\Delta\varepsilon(x)$ is employed at S11 to find the critical buckling strain difference distribution $\Delta\varepsilon_{cr}(x)$.

Second Exemplary Embodiment

Figure 12:
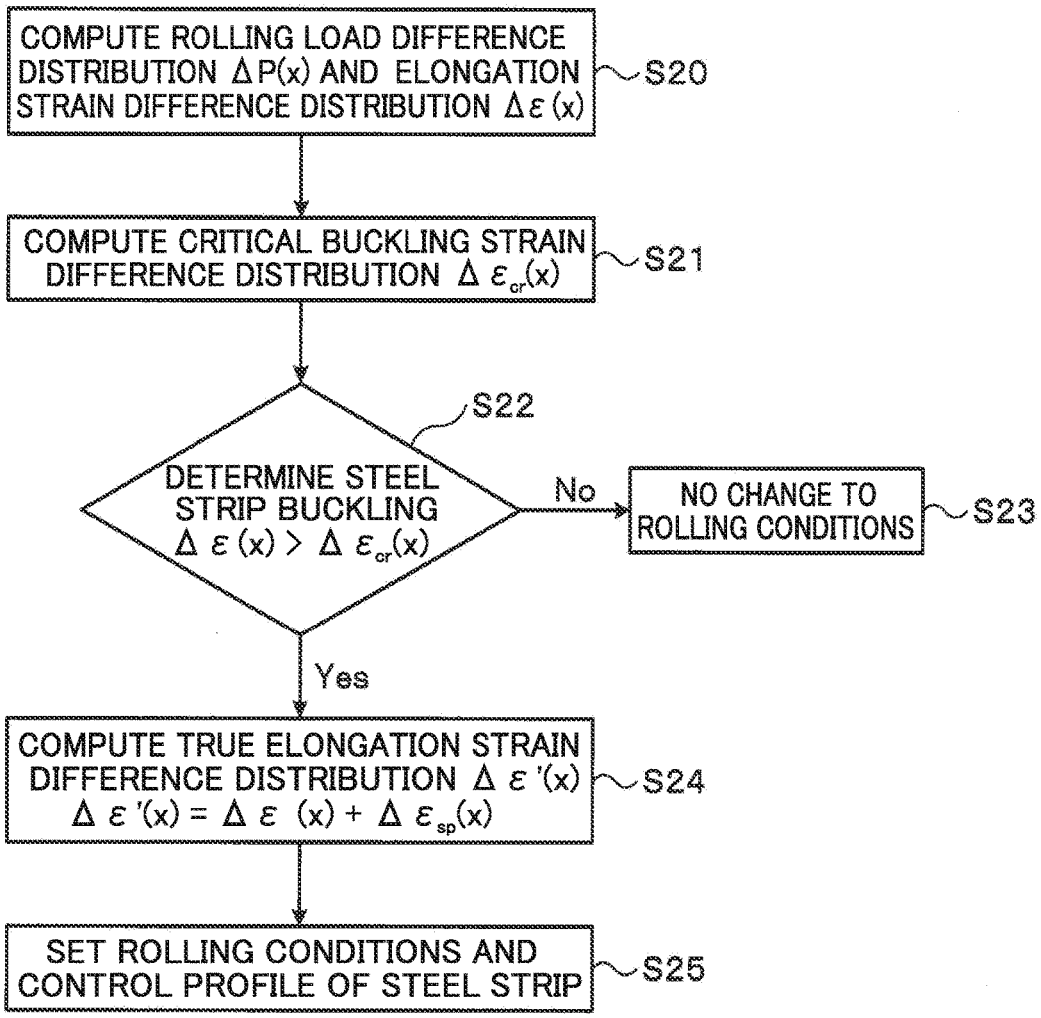
FIG. 12 is a flowchart illustrating a steel strip rolling control method of a second exemplary embodiment.

Next, explanation follows regarding a second exemplary embodiment of a method for controlling the profile of the steel strip H after rolling. FIG. 12 is a flowchart illustrating a rolling control method of the steel strip H in the second exemplary embodiment.

First, under conditions in which out-of-plane deformation of the steel strip H is restrained, a provisional rolling load difference distribution $\Delta P(x)$ in the strip width direction, and a provisional elongation strain difference distribution $\Delta\varepsilon(x)$ in the strip width direction of the steel strip H during rolling under specific rolling conditions, are found (step S20 in FIG. 12). Similarly to at step S10, the provisional rolling load difference distribution $\Delta P(x)$ and the provisional elongation strain difference distribution $\Delta\varepsilon(x)$ may be computed using a known method, such as an FEM, a slab method, physical modeling, or a regression formula from experimentation or computation.

Next, the critical buckling strain difference distribution $\Delta\varepsilon_{cr}(x)$ in the strip width direction of the steel strip H is found based on the provisional elongation strain difference distribution $\Delta\varepsilon(x)$ found at step S20, the strip thickness and the strip width of the steel strip H, and the tension acting on the steel strip H at the exit from the rolling mill (step S21 in FIG. 12). Step S21 is performed using a similar method to step S11 above.

Next, determination is made as to whether or not the steel strip H will buckle (step S22 in FIG. 12). Step S22 is performed using a similar method to step S12 above.

At step S22, in cases in which determination is made that the provisional elongation strain difference distribution $\Delta\varepsilon(x)$ found at step S20 does not exceed the critical buckling strain difference distribution $\Delta\varepsilon_{cr}(x)$ found at step S21, then it is presumed that the steel strip H will not buckle. In such cases, the profile of the steel strip H is controlled by leaving the rolling conditions as they are, without any changes, and rolling the steel strip H (step S23 in FIG. 12).

Figure 13:
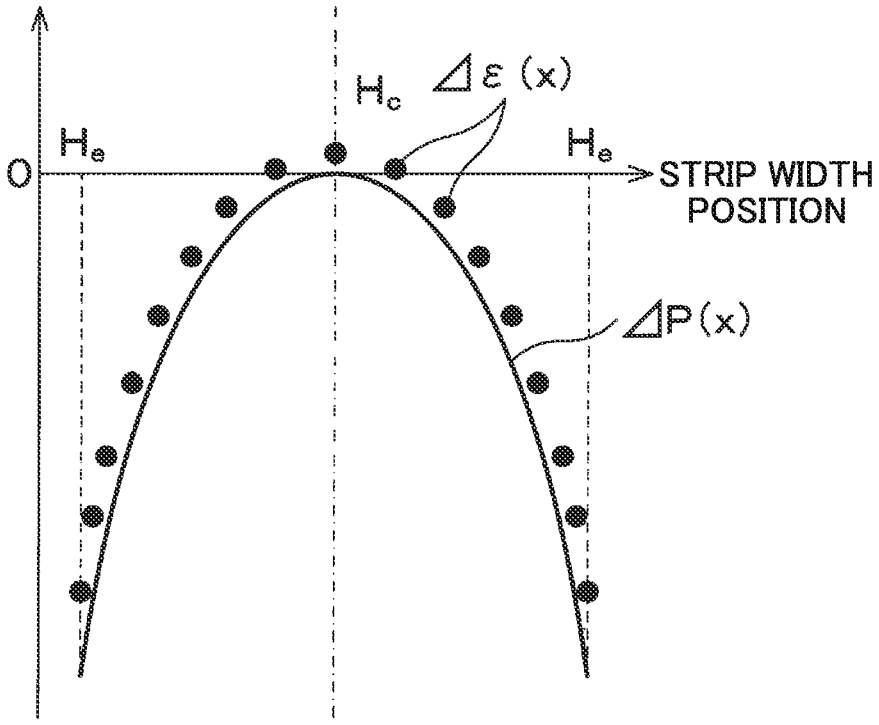
FIG. 13 is a diagram illustrating a correlation between a rolling load difference distribution $\Delta P(x)$ and an elongation strain difference distribution $\Delta\varepsilon(x)$.

However, in cases in which, at step S22, determination is made that the provisional elongation strain difference distribution $\Delta\varepsilon(x)$ found at step S20 exceeds the critical buckling strain difference distribution $\Delta\varepsilon_{cr}(x)$ found at step S21, it is presumed that the steel strip H will buckle. In such cases, the correlation between the provisional rolling load difference distribution $\Delta P(x)$ and the provisional elongation strain difference distribution $\Delta\varepsilon(x)$ found at step S20 is found, as illustrated in FIG. 13. Based on this correlation, the critical buckling load difference distribution $\Delta P_{cr}(x)$ that corresponds to the critical buckling strain difference distribution $\Delta\varepsilon_{cr}(x)$ found at step S21 is found. Then, the out-of-plane deformation load difference distribution $\Delta P_{sp}(x)$, which is the difference between the provisional rolling load difference distribution $\Delta P(x)$ found at step S20 and the critical buckling load difference distribution $\Delta P_{cr}(x)$ found at step S24, is found ($\Delta P_{sp}(x)=\Delta P(x)-\Delta P_{cr}(x)$). Moreover, making the assumption that there is no crown ratio change in the metal strip between exit from and entry to the rolling mill, a known method such as an FEM, a slab method, physical modeling, or a regression formula from experimentation or computation is employed to find the out-of-plane deformation strain difference distribution $\Delta\varepsilon_{sp}(x)$ from the out-of-plane deformation load difference distribution $\Delta P_{sp}(x)$. Note that the correlation between the provisional rolling load difference distribution $\Delta P(x)$ and the provisional elongation strain difference distribution $\Delta\varepsilon(x)$ found at step S20 may be employed when finding the out-of-plane deformation strain difference distribution $\Delta\varepsilon_{sp}(x)$ from the out-of-plane deformation load difference distribution $\Delta P_{sp}(x)$. Then, the true elongation strain difference distribution $\Delta\varepsilon(x)$ is found by adding the out-of-plane deformation strain difference distribution $\Delta\varepsilon_{sp}(x)$ to the provisional elongation strain difference distribution $\Delta\varepsilon(x)$ found at step S20, as in Equation (9) below (step S24 in FIG. 12).

$$\Delta\varepsilon'(x)=\Delta\varepsilon(x)+\Delta\varepsilon_{sp}(x) \tag{9}$$

Next, the profile of the steel strip H is controlled by setting rolling conditions based on the true elongation strain difference distribution $\Delta\varepsilon'(x)$ found at step S24, and rolling the steel strip H (step S25 in FIG. 12). Step S25 is performed using a similar method to step S15 above.

The second exemplary embodiment is a modified example of the first exemplary embodiment described above. The method for computing the increase in the elongation strain difference distribution from the provisional elongation strain difference distribution $\Delta\varepsilon(x)$ differs between the first exemplary embodiment and the second exemplary embodiment. At step S14 of the first exemplary embodiment, the increase in the strain difference is found from the difference between the provisional elongation strain difference distribution $\Delta\varepsilon(x)$ and the critical buckling strain difference distribution $\Delta\varepsilon_{cr}(x)$. However, at step S24 of the second exemplary embodiment, the increase in the strain difference is found from the difference between the provisional rolling load difference distribution $\Delta P(x)$ and the critical buckling load difference distribution $\Delta P_{cr}(x)$. Accordingly, the second exemplary embodiment can enjoy similar advantageous effects to the first exemplary embodiment. Namely, the true elongation strain difference distribution $\Delta\varepsilon'(x)$ of the steel strip H can be predicted more precisely and more accurately than hitherto. Moreover, setting the rolling conditions based on the true elongation strain difference distribution $\Delta\varepsilon'(x)$ enables excellent control of the profile of the steel strip H after rolling.

Third Exemplary Embodiment

Figure 14:
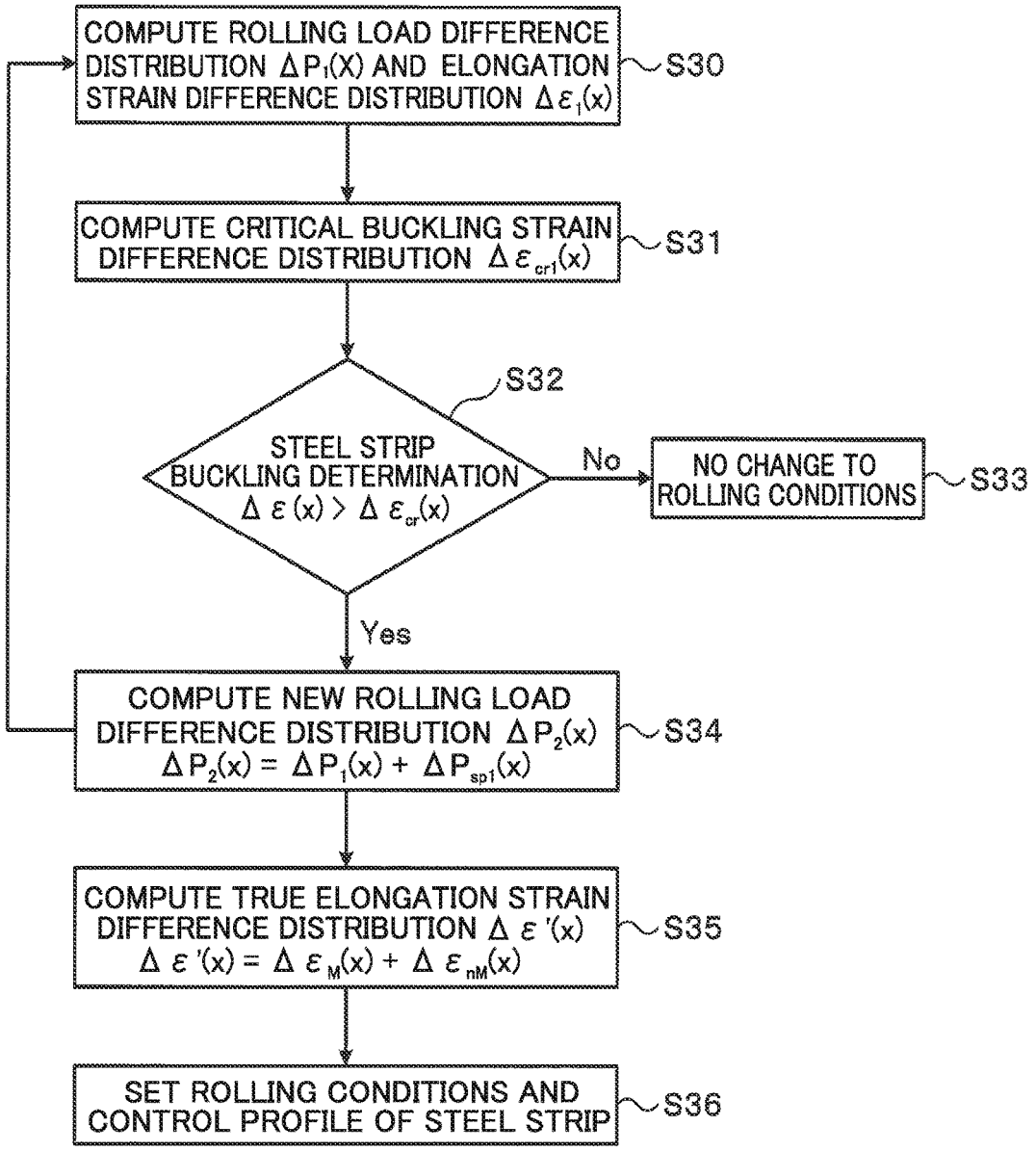
FIG. 14 is a flowchart illustrating a steel strip rolling control method of a third exemplary embodiment.

Explanation follows regarding a third exemplary embodiment of a method for controlling the profile of the steel strip H after rolling. FIG. 14 is a flowchart illustrating a rolling control method of the steel strip H in the third exemplary embodiment.

In the third exemplary embodiment, steps S30 to S33 in the flowchart illustrated in FIG. 14 are similar to the respective steps S20 to S23 of the second exemplary embodiment. Note that steps S30 to S34 are performed repeatedly, as described below, and so, for ease of explanation, the number of times of repetition is appended as a suffix of each parameter. For example, when step S30 is performed for the first time, a rolling load difference distribution $\Delta P_1(x)$ and an elongation strain difference distribution $\Delta\varepsilon_1(x)$ are found, and when step S31 is performed for the first time, a critical buckling strain difference distribution $\Delta\varepsilon_{cr1}(x)$ is found.

Figure 15:
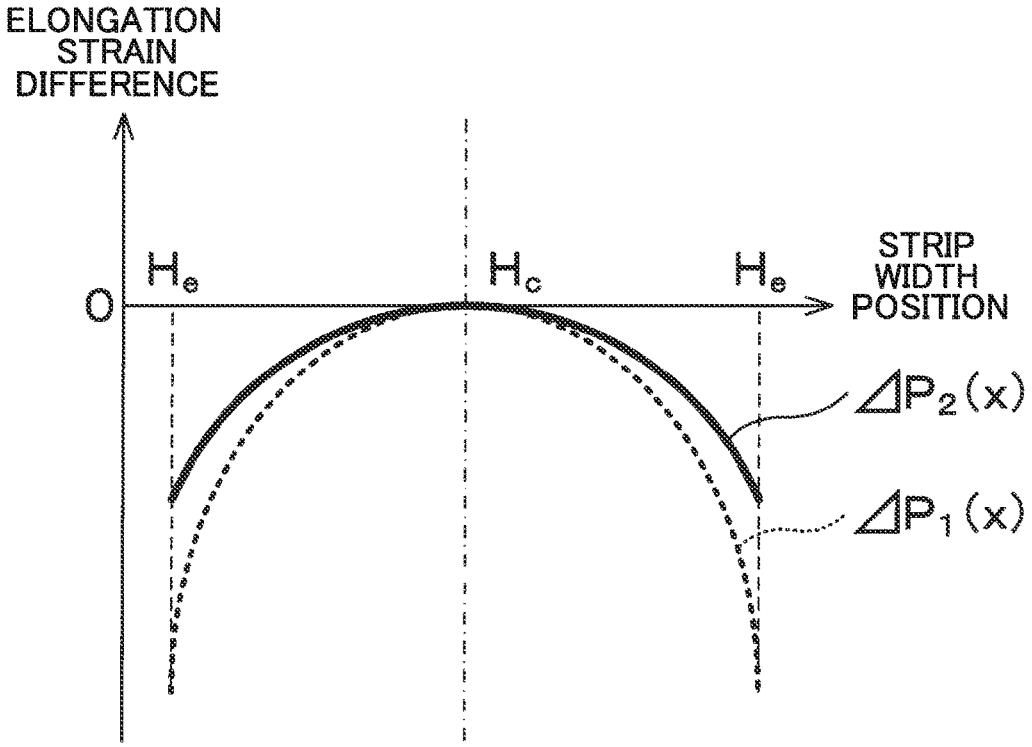
FIG. 15 is a diagram illustrating a new rolling load difference distribution $\Delta P_2(x)$.

Step S34 is processing performed in cases in which, at step S32, determination is made that the provisional elongation strain difference distribution $\Delta\varepsilon_1(x)$ found at step S30 exceeds the critical buckling strain difference distribution $\Delta\varepsilon_{cr1}(x)$ found at step S31, and that the steel strip H will buckle. In such cases, the correlation is found between the provisional rolling load difference distribution $\Delta P_1(x)$ and the provisional elongation strain difference distribution $\Delta\varepsilon_1(x)$ found at step S30, as illustrated in FIG. 13. Moreover, an out-of-plane deformation strain difference distribution $\Delta\varepsilon_{sp1}(x)$ is found, which is the difference between the provisional elongation strain difference distribution $\Delta\varepsilon_1(x)$ found at step S30 and the critical buckling strain difference distribution $\Delta\varepsilon_{cr1}(x)$ found at step S31, ($\Delta\varepsilon_{sp1}(x)=\Delta\varepsilon_1(x)-\Delta\varepsilon_{cr1}(x)$). Based on the above correlation, an out-of-plane deformation load difference distribution $\Delta P_{sp1}(x)$ corresponding to the out-of-plane deformation strain difference distribution $\Delta\varepsilon_{sp1}(x)$ is found. Then, as illustrated in FIG. 15, the out-of-plane deformation load difference distribution $\Delta P_{sp1}(x)$ is superimposed on the provisional rolling load difference distribution $\Delta P_1(x)$ found at step S30 to compute a new rolling load difference distribution $\Delta P_2(x)$ (step S34 in FIG. 14). Namely, the new rolling load difference distribution $\Delta P_2(x)$ can be expressed by Equation (10) below.

$$\Delta P_2(x)=\Delta P_1(x)+\Delta P_{sp1}(x) \tag{10}$$

Note that when buckling has occurred, the out-of-plane deformation load difference distribution $\Delta P_{sp1}(x)$ disappears, and so in practice, in order to find $\Delta P_2(x)$, processing is performed to subtract $\Delta P_{sp1}(x)$ from $\Delta P_1(x)$.

In the third exemplary embodiment, it is assumed that there is a change in the crown ratio of the metal strip between exit from and entry to the rolling mill. Namely, when there is a fluctuation in rolling load acting on the steel strip H, it is assumed that the deflection of the rollers of the rolling mill 10 fluctuates due to the fluctuation in the rolling load, and the elongation strain of the steel strip H also fluctuates. Moreover, an average rolling load is added to the new rolling load difference distribution $\Delta P_2(x)$ found at step S34 to find a new rolling load difference distribution, and processing returns to step S30 and a new elongation strain difference distribution $\Delta\varepsilon_2(x)$ is computed based on the new rolling load difference distribution. Then, at step S31, a new critical buckling strain difference distribution $\Delta\varepsilon_{cr2}(x)$ is found based on the new elongation strain difference distribution $\Delta\varepsilon_2(x)$, the strip thickness and strip width of the steel strip H, and the tension acting on the steel strip H at exit from the rolling mill. Then, after going through step S32, a new rolling load difference distribution $\Delta P_3(x)$ is again computed at step S34. Note that the correlation between the rolling load difference distribution $\Delta P_1(x)$ and the elongation strain difference distribution $\Delta\varepsilon_1(x)$ employed on the first occasion at step S34 may be found as the correlation between the rolling load difference distribution and the elongation strain difference distribution, and this correlation may be employed repeatedly from the second occasion onward.

Steps S30 to S34 are performed M times (M being a positive integer) so as to finally compute an elongation strain difference distribution $\Delta\varepsilon_M(x)$ and a new critical buckling strain difference distribution $\Delta\varepsilon_{crM}(x)$. A buckling exacerbation strain difference distribution $\Delta\varepsilon_{nM}(x)$, which is the difference between the elongation strain difference distribution $\Delta\varepsilon_M(x)$ and the new critical buckling strain difference distribution $\Delta\varepsilon_{crM}(x)$, is then found ($\Delta\varepsilon_{nM}(x)=\Delta\varepsilon_M(x)-\Delta\varepsilon_{crM}(x)$). Then, the true elongation strain difference distribution $\Delta\varepsilon'(x)$ is found by adding the buckling exacerbation strain difference distribution $\Delta\varepsilon_{nM}(x)$ to the elongation strain difference distribution $\Delta\varepsilon_M(x)$, as in Equation (11) below (step S35 in FIG. 14).

$$\Delta\varepsilon'(x)=\Delta\varepsilon_M(x)+\Delta\varepsilon_{nM}(x) \tag{11}$$

Next, the profile of the steel strip H is controlled by setting rolling conditions based on the true elongation strain difference distribution $\Delta\varepsilon'(x)$ found at step S35, and rolling the steel strip H (step S36 in FIG. 14). Step S36 is performed using a similar method to step S25 above.

In the third exemplary embodiment, steps S30 to S34 are performed repeatedly, under the assumption that there is a change in the crown ratio of the metal strip between exit from and entry to the rolling mill. This thereby enables the precision of the buckling exacerbation strain difference distribution $\Delta\varepsilon_{nM}(x)$ to be improved, and enables the true elongation strain difference distribution $\Delta\varepsilon'(x)$ of the steel strip H be predicted with even greater precision.

Figure 16:
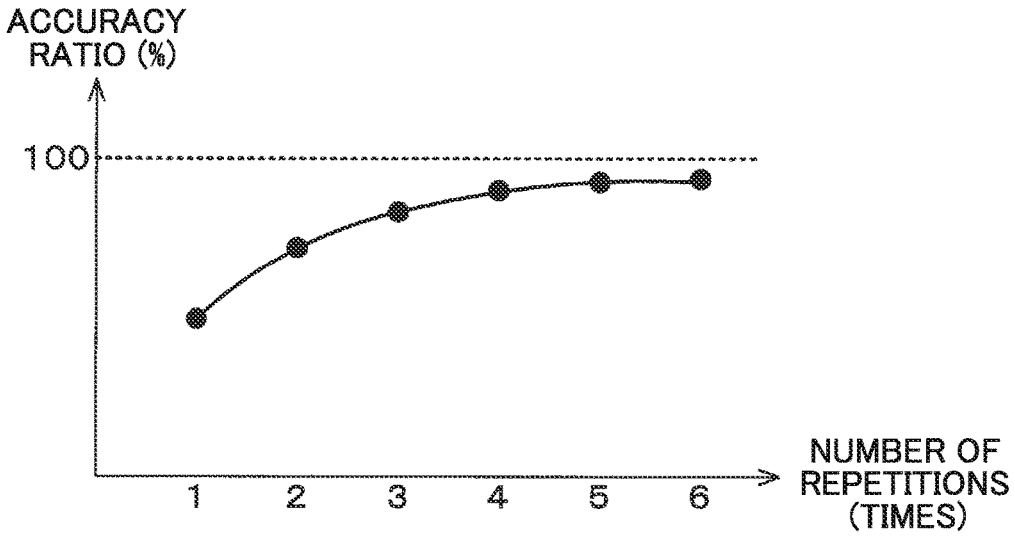
FIG. 16 is a graph to explain advantageous effects of the third exemplary embodiment.

FIG. 16 is a graph to explain advantageous effects of the third exemplary embodiment. In FIG. 16, the horizontal axis indicates the number of repetitions M of steps S30 to S34, and the vertical axis indicates the accuracy ratio when predicting the profile of the steel strip. The "accuracy ratio" here refers to a ratio of the steepness of the steel strip obtained by simulation against the steepness of a steel strip actually manufactured (computed steepness/actual steepness). Note that "steepness" is an index indicating the extent of center stretching, edge stretching, and the like, and is a value expressing the ratio of a wave height against the pitch of the wave as a percentage. It can be seen from FIG. 16 that the accuracy ratio of profile prediction improves as the number of repetitions M increases.

Note that the number of repetitions M can be set as desired, and, for example, a predetermined number of repetitions may be set, or alternatively, processing may be repeated until the buckling exacerbation strain difference distribution $\Delta\varepsilon_{nM}(x)$ converges.

Other Exemplary Embodiments

Figure 17:
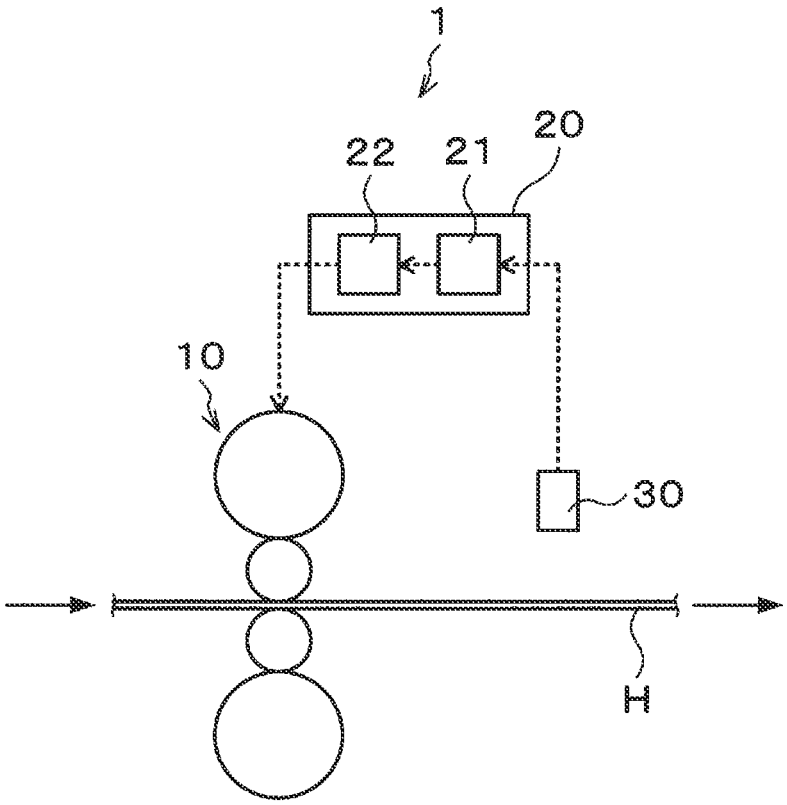
FIG. 17 is a diagram schematically illustrating a rolling line provided with a rolling mill, a rolling controller, and a profile meter.

The first exemplary embodiment, the second exemplary embodiment, and the third exemplary embodiment described above are each implemented using the rolling line 1 illustrated in FIG. 17. The rolling line 1 includes the rolling mill 10 described above, and a rolling controller 20 that controls the rolling mill 10. The rolling controller 20 includes a computation section 21 and a control section 22. The computation section 21 performs computation for the steps S10 to S14 of the first exemplary embodiment, the steps S20 to S24 of the second exemplary embodiment, and the steps S30 to S35 of the third exemplary embodiment. The control section 22 sets rolling conditions based on the computation results of the computation section 21, namely based on the true elongation strain difference distribution $\Delta\varepsilon'(x)$. These rolling conditions are output to the rolling mill 10, and the rolling mill 10 is controlled so as to control the profile of the steel strip H after rolling.

Figure 18:
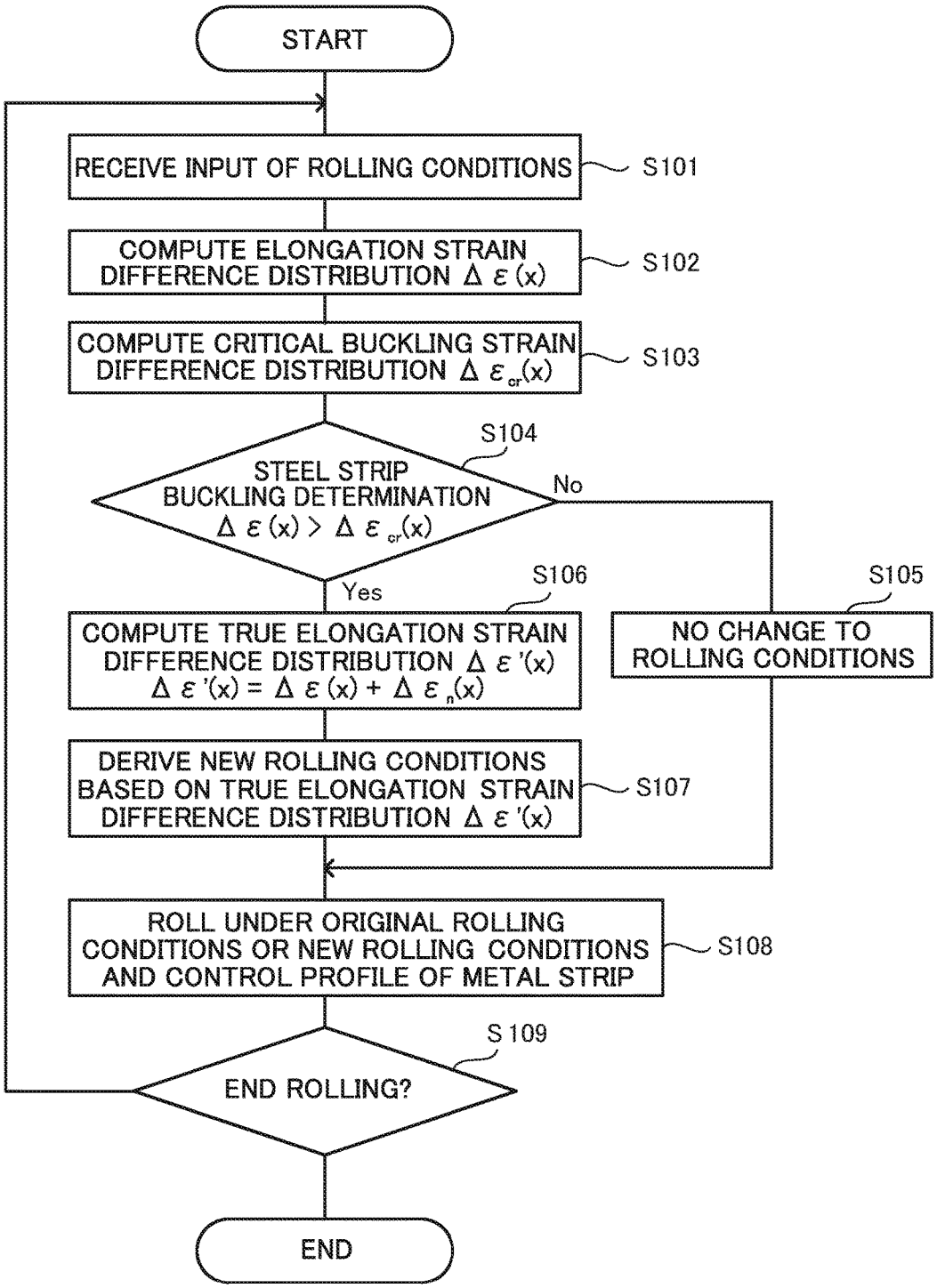
FIG. 18 is a flowchart illustrating a flow of processing executed by a rolling controller according to an exemplary embodiment of the present invention.

FIG. 18 is a flowchart illustrating an example of a flow of processing executed by the rolling controller 20.

At step S101, the computation section 21 receives input of provisional rolling conditions set for the rolling controller 20.

At step S102, the computation section 21 finds the provisional elongation strain difference distribution $\Delta\varepsilon(x)$ in the strip width direction of the steel strip H during rolling based on the received input of rolling conditions.

At step S103, the computation section 21 finds the critical buckling strain difference distribution $\Delta\varepsilon_{cr}(x)$ in the strip width direction of the steel strip H based on the provisional elongation strain difference distribution $\Delta\varepsilon(x)$ found at step S102, the strip thickness and strip width of the steel strip H, and the tension acting on the steel strip H at exit from the rolling mill.

At step S104, the computation section 21 performs buckling determination. Specifically, the computation section 21 determines whether or not the provisional elongation strain difference distribution $\Delta\varepsilon(x)$ found at step S102 and the critical buckling strain difference distribution $\Delta\varepsilon_{cr}(x)$ found at step S103 satisfy Equation (6). In cases in which the computation section 21 determines that Equation (6) has been satisfied (in cases in which it is presumed that buckling will occur), processing transitions to step S106, and in cases in which the computation section 21 determines that Equation (6) has not been satisfied (in cases in which it is presumed that buckling will not occur), processing transitions to step S105.

At step S105, the computation section 21 notifies the control section 22 that there is no need to change the input provisional rolling conditions that were received at step S101.

At step S106, the computation section 21 finds the difference between the provisional elongation strain difference distribution $\Delta\varepsilon(x)$ found at step S102 and the critical buckling strain difference distribution $\Delta\varepsilon_{cr}(x)$ found at step S103 as the buckling exacerbation strain difference distribution $\Delta\varepsilon_n(x)$ ($\Delta\varepsilon_n(x)=\Delta\varepsilon(x)-\Delta\varepsilon_{cr}(x)$). The computation section 21 then uses Equation (1) to find the true elongation strain difference distribution $\Delta\varepsilon'(x)$ by adding the buckling exacerbation strain difference distribution $\Delta\varepsilon_n(x)$ to the provisional elongation strain difference distribution $\Delta\varepsilon(x)$. The computation section 21 then supplies the true elongation strain difference distribution $\Delta\varepsilon'(x)$, derived as described above, to the control section.

At step S107, the control section 22 derives new rolling conditions based on the true elongation strain difference distribution $\Delta\varepsilon'(x)$. For example, the control section 22 derives new rolling conditions such that the true elongation strain difference distribution $\Delta\varepsilon'(x)$ becomes equal to or lower than the critical buckling strain difference distribution $\Delta\varepsilon_{cr}(x)$. Note that the new rolling conditions may be derived by the computation section 21.

At step S108, in cases in which the control section 22 has received notification from the computation section 21 that there is no need to change the rolling conditions, the control section 22 outputs the original rolling conditions to the rolling mill 10 and controls the rolling mill 10, thereby controlling the profile of the steel strip H after rolling. However, in cases in which the control section 22 has derived new rolling conditions at step S107, the control section 22 outputs the new rolling conditions to the rolling mill 10 and controls the rolling mill 10, thereby controlling the profile of the steel strip H after rolling.

At step S109, the control section 22 determines whether or not to end rolling. The control section 22 returns processing to step S101 in cases in which the control section 22 has determined not to end rolling, and ends the present routine in cases in which the control section 22 has determined to end rolling.

Note that in the flow of processing of the rolling controller 20 illustrated in FIG. 18, explanation has been given regarding an example corresponding to the rolling control method according to FIG. 6 (the first exemplary embodiment). However, the rolling controller 20 may be configured to execute processing corresponding to the rolling control method according to FIG. 12 (the second exemplary embodiment) or FIG. 14 (the third exemplary embodiment).

A profile meter 30 may be installed at the exit from the rolling mill 10 in the rolling line 1. The profile meter 30 measures the profile of the steel strip H after rolling. The profile of the steel strip H is measured by positions in the rolling direction and positions in the strip width direction of the steel strip H, and the height displacement at these positions. The measurement results of the profile meter 30 are output to the rolling controller 20. In the computation section 21 of the rolling controller 20, the out-of-plane deformation strain difference distribution $\Delta\varepsilon_{sp}(x)$ is corrected based on the measurement results of the profile meter 30, accompanying which the true elongation strain difference distribution $\Delta\varepsilon'(x)$ is also corrected. Correction of the true elongation strain difference distribution $\Delta\varepsilon'(x)$ is performed using the method described in JP-A No. 2012-218010. Namely, first, an actual out-of-plane deformation strain difference distribution $\Delta\varepsilon_{sp}(x)$ is found based on the measurement results of the profile meter 30. The actual out-of-plane deformation strain difference distribution $\Delta\varepsilon_{sp}(x)$ and an out-of-plane deformation strain difference distribution $\Delta\varepsilon_{sp}(x)$ predicted using an exemplary embodiment described above are compared against each other, and a difference (error) E therebetween is taken as the model error. Based on the error E, learning is performed and the provisional elongation strain difference distribution $\Delta\varepsilon(x)$ (rolling load difference distribution $\Delta P(x)$) found at step S10, S20, or S30 is corrected. Specifically, the error E is added to the provisional elongation strain difference distribution $\Delta\varepsilon(x)$ (rolling load difference distribution $\Delta P(x)$) found at step S10, S20, or S30, and then the respective subsequent processing is performed in order to find the true elongation strain difference distribution $\Delta\varepsilon'(x)$. Then, the control section 22 corrects the rolling conditions based on the corrected result of the true elongation strain difference distribution $\Delta\varepsilon'(x)$ by the computation section 21 such that the profile of the steel strip H will achieve a target profile. In this manner, the rolling conditions are feedback controlled based on the measurement results of the profile meter 30. The inventors found from their investigations that performing such feedback control improves yield due to profile by a further 0.5%.

The present invention may also be applied in cases in which the steel strip H undergoes out-of-plane deformation on entry to the rolling mill 10. The inventors found from their investigations that in cases in which the steel strip H undergoes such out-of-plane deformation on entry to the rolling mill, the elongation strain difference distribution of the steel strip H after rolling increases in comparison to cases in which the steel strip H does not undergo out-of-plane deformation on entry to the rolling mill. In other words, the prediction precision of the profile of the steel strip becomes even poorer when using known methods. By contrast, in the present invention, since the elongation strain difference distribution corresponding to the amount of out-of-plane deformation at entry to the rolling mill can be included in the out-of-plane deformation strain difference distribution $\Delta\varepsilon_{sp}(x)$, there is no effect on the prediction of the true elongation strain difference distribution $\Delta\varepsilon'(x)$ of the steel strip H. This thereby enables the profile of the steel strip H to be appropriately controlled even when the steel strip H undergoes out-of-plane deformation at entry to the rolling mill.

Note that in the exemplary embodiments described above, the present invention has been explained using an example in which a center wave is generated in the steel strip. However, the present invention may also be applied in cases in which edge waves or quarter waves are generated.

Explanation has been given regarding preferable exemplary embodiments of the present invention with reference to the attached drawings. However, the present invention is not limited to these examples. It would be clear to a person skilled in the art that various modifications or adjustments may be made within the scope of the concepts recited in the scope of claims, and a person skilled in the art would understand that these would obviously fall within the technical scope of the present invention.

INDUSTRIAL APPLICABILITY

The present invention is useful in cases in which the profile of a metal strip, for example a sheet or a plate, after rolling is predicted, and the profile of the metal strip is controlled based on the prediction results.

The disclosure of Japanese Patent Application No. 2014-187290, filed on Sep. 16, 2014, is incorporated in its entirety by reference herein. All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. A rolling control method comprising:

finding a critical buckling strain difference distribution, which is a distribution in a strip width direction of differences in a critical strain at which a metal strip will buckle, based on a strip thickness of the metal strip, a strip width of the metal strip, tension acting on the metal strip at exit from a rolling mill, and a provisional elongation strain difference distribution which is a distribution of differences in the strip width direction of elongation strain along a rolling direction of the metal strip during rolling under specific rolling conditions and which is found under conditions in which out-of-plane deformation of the metal strip is restrained by using an up-down asymmetrical model that permits displacement of a strip-thickness center of the metal strip within a plane of a reference plane, the reference plane being parallel to a strip surface of the metal strip and passing through a center point of a line that joins respective rotational centers of upper and lower rolls, and does not permit displacement of the strip-thickness center of the metal strip outside of the plane of the reference plane;

in cases in which the provisional elongation strain difference distribution exceeds the critical buckling strain difference distribution, finding a true elongation strain difference distribution by adding the difference between the provisional elongation strain difference distribution and the critical buckling strain difference distribution to the provisional elongation strain difference distribution; and rolling the metal strip without changing the specific rolling conditions in cases in which the provisional elongation strain difference distribution does not exceed the critical buckling strain difference distribution, and rolling the metal strip under rolling conditions set based on the true elongation strain difference distribution in cases in which the provisional elongation strain difference distribution exceeds the critical buckling strain difference distribution.

2. The rolling control method of claim 1, further comprising finding the provisional elongation strain difference distribution.

3. The rolling control method of claim 1, wherein, when finding the true elongation strain difference distribution, a converted tension is found by converting a difference between the provisional elongation strain difference distribution and the critical buckling strain difference distribution into tension acting on the metal strip at exit from the rolling mill, and the true elongation strain difference distribution is found by adding an elongation strain difference distribution corresponding to the converted tension to the provisional elongation strain difference distribution.

4. The rolling control method of claim 3, wherein, when finding the true elongation strain difference distribution, a second order differential with respect to the strip width direction of a rolling load difference distribution in the strip width direction of the metal strip corresponding to the converted tension is found as an elongation strain difference distribution corresponding to the converted tension.

5. The rolling control method of claim 1, wherein the metal strip undergoes out-of-plane deformation at entry to the rolling mill.

6. The rolling control method of claim 1, further comprising:

employing a profile meter installed at exit from the rolling mill to measure the profile of the metal strip after rolling; and correcting the provisional elongation strain difference distribution based on a difference between an actual elongation strain difference distribution that has been transformed into out-of-plane deformation found from a measured profile of the metal strip, and an elongation strain difference distribution predicted to be transformed into out-of-plane deformation.

7. A rolling control method comprising:

under conditions in which out-of-plane deformation of a metal strip is restrained, finding a provisional rolling load difference distribution, which is a distribution of differences in rolling load in a strip width direction of the metal strip during rolling under specific rolling conditions, and finding a provisional elongation strain difference distribution, which is a distribution of differences in the strip width direction in elongation strain along a rolling direction of the metal strip during rolling, by using an up-down asymmetrical model that permits displacement of a strip-thickness center of the metal strip within a plane of a reference plane, the reference plane being parallel to a strip surface of the metal strip and passing through a center point of a line that joins respective rotational centers of upper and lower rolls, and does not permit displacement of the strip-thickness center of the metal strip outside of the plane of the reference plane;

finding a critical buckling strain difference distribution, which is a distribution in the strip width direction of differences in a critical strain at which the metal strip will buckle, based on the provisional elongation strain difference distribution, a strip thickness of the metal strip, a strip width of the metal strip, and tension acting on the metal strip at exit from a rolling mill;

in cases in which the provisional elongation strain difference distribution exceeds the critical buckling strain difference distribution, finding an out-of-plane deformation load difference distribution corresponding to an out-of-plane deformation strain difference distribution, which is a difference between the provisional elongation strain difference distribution and the critical buckling strain difference distribution, from a correlation between the provisional rolling load difference distribution and the provisional elongation strain difference distribution, deriving a new rolling load difference distribution by superimposing the out-of-plane deformation load difference distribution on the provisional rolling load difference distribution, finding a new elongation strain difference distribution based on the new rolling load difference distribution under the assumption that there is a change in a crown ratio of the metal strip, and further finding a new critical buckling strain difference distribution based on the new elongation strain difference distribution, the strip thickness and the strip width of the metal strip, and tension acting on the metal strip at exit from the rolling mill;

finding a difference between the new elongation strain difference distribution and the new critical buckling strain difference distribution, and finding a true elongation strain difference distribution by adding this difference to the new elongation strain difference distribution; and rolling the metal strip without changing the specific rolling conditions in cases in which the provisional elongation strain difference distribution does not exceed the critical buckling strain difference distribution, and rolling the metal strip under rolling conditions that are set based on the true elongation strain difference distribution in cases in which the provisional elongation strain difference distribution exceeds the critical buckling strain difference distribution.

8. The rolling control method of claim 7, wherein finding the out-of-plane deformation load difference distribution is performed a plurality of times by taking the new elongation strain difference distribution as the provisional elongation strain difference distribution, and taking the new critical buckling strain difference distribution as the critical buckling strain difference distribution.

9. A rolling control method comprising:

under conditions in which out-of-plane deformation of a metal strip is restrained, finding a provisional rolling load difference distribution, which is a distribution of differences in rolling load in a strip width direction of the metal strip during rolling under specific rolling conditions, and finding a provisional elongation strain difference distribution, which is a distribution of differences in the strip width direction in elongation strain along a rolling direction of the metal strip during rolling, by using an up-down asymmetrical model that permits displacement of a strip-thickness center of the metal strip within a plane of a reference plane, the reference plane being parallel to a strip surface of the metal strip and passing through a center point of a line that joins respective rotational centers of upper and lower rolls, and does not permit displacement of the strip-thickness center of the metal strip outside of the plane of the reference plane;

finding a critical buckling strain difference distribution, which is a distribution in the strip width direction of differences in a critical strain at which the metal strip will buckle, based on the provisional elongation strain difference distribution, a strip thickness of the metal strip, a strip width of the metal strip, and tension acting on the metal strip at exit from a rolling mill;

in cases in which the provisional elongation strain difference distribution exceeds the critical buckling strain difference distribution, finding a critical buckling load difference distribution, which is a rolling load difference distribution corresponding to the critical buckling strain difference distribution, from a correlation between the provisional rolling load difference distribution and the provisional elongation strain difference distribution, finding a difference between the provisional rolling load difference distribution and the critical buckling load difference distribution, and finding a true elongation strain difference distribution by adding a strain difference distribution, corresponding to the difference, to the provisional elongation strain difference distribution under the assumption that there is no crown ratio change in the metal strip between exit from and entry to the rolling mill; and rolling the metal strip without changing the specific rolling conditions in cases in which the provisional elongation strain difference distribution does not exceed the critical buckling strain difference distribution, and rolling the metal strip under rolling conditions that are set based on the true elongation strain difference distribution in cases in which the provisional elongation strain difference distribution exceeds the critical buckling strain difference distribution.

10. A manufacturing method for a rolled metal strip, the manufacturing method comprising:

finding a critical buckling strain difference distribution, which is a distribution in a strip width direction of differences in a critical strain at which a metal strip will buckle, based on a strip thickness of the metal strip, a strip width of the metal strip, tension acting on the metal strip at exit from a rolling mill, and a provisional elongation strain difference distribution, which is a distribution of differences in the strip width direction of elongation strain along a rolling direction of the metal strip during rolling under specific rolling conditions, and which is found under conditions in which out-of-plane deformation of a metal strip is restrained by using an up-down asymmetrical model that permits displacement of a strip-thickness center of the metal strip within a plane of a reference plane, the reference plane being parallel to a strip surface of the metal strip and passing through a center point of a line that joins respective rotational centers of upper and lower rolls, and does not permit displacement of the strip-thickness center of the metal strip outside of the plane of the reference plane, and;

in cases in which the provisional elongation strain difference distribution exceeds the critical buckling strain difference distribution, finding a true elongation strain difference distribution by adding the difference between the provisional elongation strain difference distribution and the critical buckling strain difference distribution to the provisional elongation strain difference distribution; and rolling the metal strip without changing the rolling conditions in cases in which the provisional elongation strain difference distribution does not exceed the critical buckling strain difference distribution, and rolling the metal strip under rolling conditions set based on the true elongation strain difference distribution in cases in which the provisional elongation strain difference distribution exceeds the critical buckling strain difference distribution.

11. A rolling controller comprising:

a computer configured to:

find a provisional elongation strain difference distribution, which is a distribution of differences in the strip width direction of elongation strain along a rolling direction of the metal strip during rolling, under conditions in which out-of-plane deformation of a metal strip is restrained by using an up-down asymmetrical model that permits displacement of a strip-thickness center of the metal strip within a plane of a reference plane, the reference plane being parallel to a strip surface of the metal strip and passing through a center point of a line that joins respective rotational centers of upper and lower rolls, and does not permit displacement of the strip-thickness center of the metal strip outside of the plane of the reference plane;

find a critical buckling strain difference distribution, which is a distribution in a strip width direction of differences in a critical strain at which a metal strip will buckle, based on a strip thickness of the metal strip, a strip width of the metal strip, tension acting on the metal strip at exit from a rolling mill, and the provisional elongation strain difference distribution, in cases in which the provisional elongation strain difference distribution exceeds the critical buckling strain difference distribution, find a true elongation strain difference distribution by adding the difference between the provisional elongation strain difference distribution and the critical buckling strain difference distribution to the provisional elongation strain difference distribution; and roll the metal strip, without changing the specific rolling conditions, in cases in which the provisional elongation strain difference distribution does not exceed the critical buckling strain difference distribution, and roll the metal strip under rolling conditions that are set based on the true elongation strain difference distribution in cases in which the provisional elongation strain difference distribution exceeds the critical buckling strain difference distribution.

* * * * *